US009162788B2

(12) United States Patent
Stone et al.

(10) Patent No.: US 9,162,788 B2
(45) Date of Patent: Oct. 20, 2015

(54) SYSTEMS, DEVICES, AND METHODS FOR AUTOMATIC UNWRAPPING OF BUNDLES

(75) Inventors: Robert L. Stone, Perry Hall, MD (US); Mohammed T. Islam, Ellicott City, MD (US); Young K. Yoo, Halethorpe, MD (US); Guillaume Pierre Julien Lacalmontie, Elkridge, MD (US)

(73) Assignee: POSTIS LLC, Halethorpe, MD (US)

( * ) Notice: Subject to any disclaimer, the term of this patent is extended or adjusted under 35 U.S.C. 154(b) by 739 days.

(21) Appl. No.: 13/440,759

(22) Filed: Apr. 5, 2012

(65) Prior Publication Data

US 2012/0255264 A1 Oct. 11, 2012

Related U.S. Application Data

(60) Provisional application No. 61/473,986, filed on Apr. 11, 2011.

(51) Int. Cl.
*B65B 43/26* (2006.01)
*B65B 69/00* (2006.01)

(52) U.S. Cl.
CPC ..... *B65B 69/0025* (2013.01)

(58) Field of Classification Search
CPC ..... B65B 69/0008; B65B 69/0025; B65B 69/0033
USPC ..... 53/381.1, 381.2, 492; 83/909; 29/564.3; 414/412
See application file for complete search history.

(56) References Cited

U.S. PATENT DOCUMENTS

| | | | | |
|---|---|---|---|---|
| 4,207,021 | A * | 6/1980 | Burdett, Jr. | 414/412 |
| 4,404,723 | A * | 9/1983 | Ohba et al. | 29/33.52 |
| 4,817,260 | A * | 4/1989 | Martin | 29/426.6 |
| 5,131,135 | A * | 7/1992 | Gronau | 29/564.3 |
| 5,371,938 | A * | 12/1994 | Martin | 29/564.3 |
| 5,375,316 | A * | 12/1994 | Carlson et al. | 29/564.3 |
| 5,771,661 | A * | 6/1998 | Martin | 53/382.1 |
| 5,970,834 | A * | 10/1999 | Garofano et al. | 83/90 |
| 7,343,722 | B1 * | 3/2008 | Rutten | 53/381.2 |
| 8,091,816 | B2 * | 1/2012 | Curles | 241/200 |
| 2009/0282787 | A1 * | 11/2009 | Pippin | 53/492 |
| 2009/0297325 | A1 * | 12/2009 | Daraie et al. | 414/800 |

* cited by examiner

*Primary Examiner* — Thanh Truong
*Assistant Examiner* — Joshua Kotis
(74) *Attorney, Agent, or Firm* — Ober, Kaler, Grimes & Shriver; Royal W. Craig

(57) ABSTRACT

A system for automatic positioning, wrapper and strap cutting, wrapper removal, wrapper and strap takeaway, and debundled stack positioning and delivery of bound mail pieces, magazines, catalogs, brochures and other similar flat items (collectively "bundles") for subsequent sorting and processing, all without damaging the contents within the bundle. Incoming bundles are supported on two supporting plates configured to move horizontally toward and away from each other, and spaced to expose a portion of the bottom surface of the bundle. A cutting device cuts the wrapping and straps on the exposed bottom portion of the bundle, and the supporting plates are moved away from each other to increase the spacing. As the spacing is increased gripping devices atop both supporting plates grab and pull the cat edges of the wrapping, until the bundle falls through to a holding device.

16 Claims, 28 Drawing Sheets

SYSTEMS, DEVICES, AND METHODS FOR AUTOMATIC UNWRAPPING OF BUNDLES

CROSS-REFERENCE TO RELATED APPLICATIONS

This application claims the benefit of U.S. Provisional Application No. 61/473,986 filed Apr. 11, 2011, which is incorporated herein by reference in its entirety.

FIELD

The disclosed subject matter relates generally to handling and opening of bundled items, and more particularly to systems, devices, methods, and computer program products for automated removal of a film wrap and/or straps/bands from a bundle.

BACKGROUND

The Postal Service receives daily a large amount of bound mail pieces, magazines, catalogs, brochures and other similar flat items for opening, sorting and subsequent delivery. These items arrive in a variety of forms including stretch wrapped pallets stacked with bundles (see FIG. 1), loose flats in postal trays, large bags of loose flats, and many other specialized containers, and are typically bound in bundles with combinations of plastic wraps and straps. The straps may be inside or outside of the plastic wrap. Before the items can be delivered to their specific addresses, the bundles and trays need to be opened, sorted, and delivered to a mail carrier.

The process of debundling, namely, the removal of the plastic wrap and/or straps from the bundles, has traditionally been done manually by an operator. See for example FIG. 2 showing a manual debundling station including a work surface for supporting the film wrapped bundles of flat articles to be sorted, an inclined surface on which the bundles are sliding toward the operator, and a bin for wrap and strap disposal. Generally, the operator picks up the bundle and manually cuts the straps and the plastic wrap using a hand held knife. The operator then removes the remnants of the wrap and straps and places the stack of loose items on a cart or a conveyable bucket for subsequent processing. This manual debundling process is both time consuming, expensive, prone to cause personal injuries to the operator (carpel tunnel syndrome, cuts, etc.), and it slows down the sorting process, which is normally highly automated. Also, generally the plastic wrap and the straps are cut on top of the bundle which then requires the operator to lift or move the bundle sideways to remove the wrapping and the straps from the bundle. Such a removal not only requires application of an additional force to lift or move the bundle to be able to remove the wrapping and the straps but also destroys the integrity of the loose bundle.

SUMMARY

The present disclosure provides devices, systems, and methods for automatic cutting and removal of wrap, bands, and strings from bundles without damaging the contents within the bundle.

Embodiments are directed generally to systems, devices, methods and computer program products for automatic bundle positioning, wrapper and strap cutting, wrapper removal, wrapper and strap takeaway, and unbundled stack positioning and delivery for subsequent item sorting and processing.

Embodiments are directed generally to systems, devices, methods and computer program products for automatic bundle positioning, wrapper and strap cutting, wrapper removal, wrapper and strap takeaway, and debundled stack positioning and delivery for subsequent item sorting and processing, wherein the bundle moves through the different stages of its debundling operation in a continually downward moving direction. Moving the bundle in a downward direction between the different stages of conveying, loading, positioning, wrap and strap cutting, wrap removal, and delivery to subsequent item sorting benefits from gravity and therefore, simplifies the automation process, maintains the integrity of the bundle, and prevents damage to the bundle.

Further, embodiments are directed to systems, devices, methods and computer program products for automatic bundle positioning, wrap and strap cutting, wrap removal, wrap and strap takeaway, and debundled stack positioning and delivery for subsequent item sorting and processing, wherein the wrap and strap cutting operation is performed on a bottom surface of the bundle.

In various embodiments, an automatic debundling system is provided comprising a debundling station which can interface with an existing mail sorter (AFSM or FSS). The debundling station can communicate with an input conveyor of the mail sorting system to receive the bundled packages to be unwrapped. The debundling station may also communicate downstream with one or more sorting stations for further processing of the debundled items before subsequent automatic address sorting.

In accordance with different aspects of the subject matter, an automatic debundling system is provided that can be a free-standing system used to debundle bundles including one or more preaddressed flat items, such as, mails, magazines, catalogs, brochures, and flyers.

BRIEF DESCRIPTION OF THE DRAWINGS

The drawings described herein are for illustration purposes only and are not intended to limit the scope of the present disclosure in any way. The invention will be best understood by reading the ensuing specification in conjunction with the drawing figures, in which like elements are designated by like reference numerals. As used herein, various embodiments can mean some or all embodiments.

DETAILED DESCRIPTION

Figure 1:
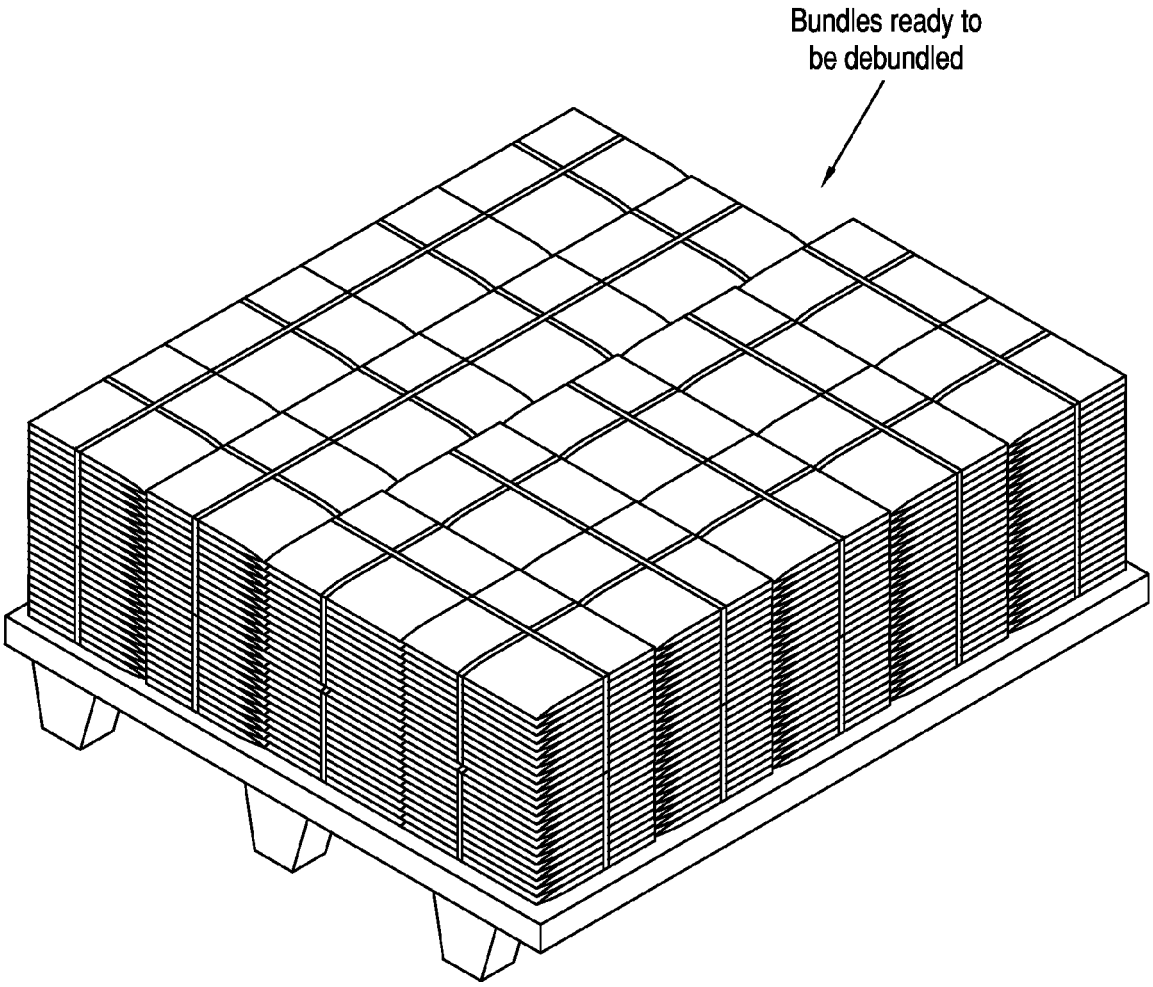
FIG. 1 (PRIOR ART)
FIG. 1 is a side perspective view of a pallet including bundles of items needing to be debundled.
Figure 2:
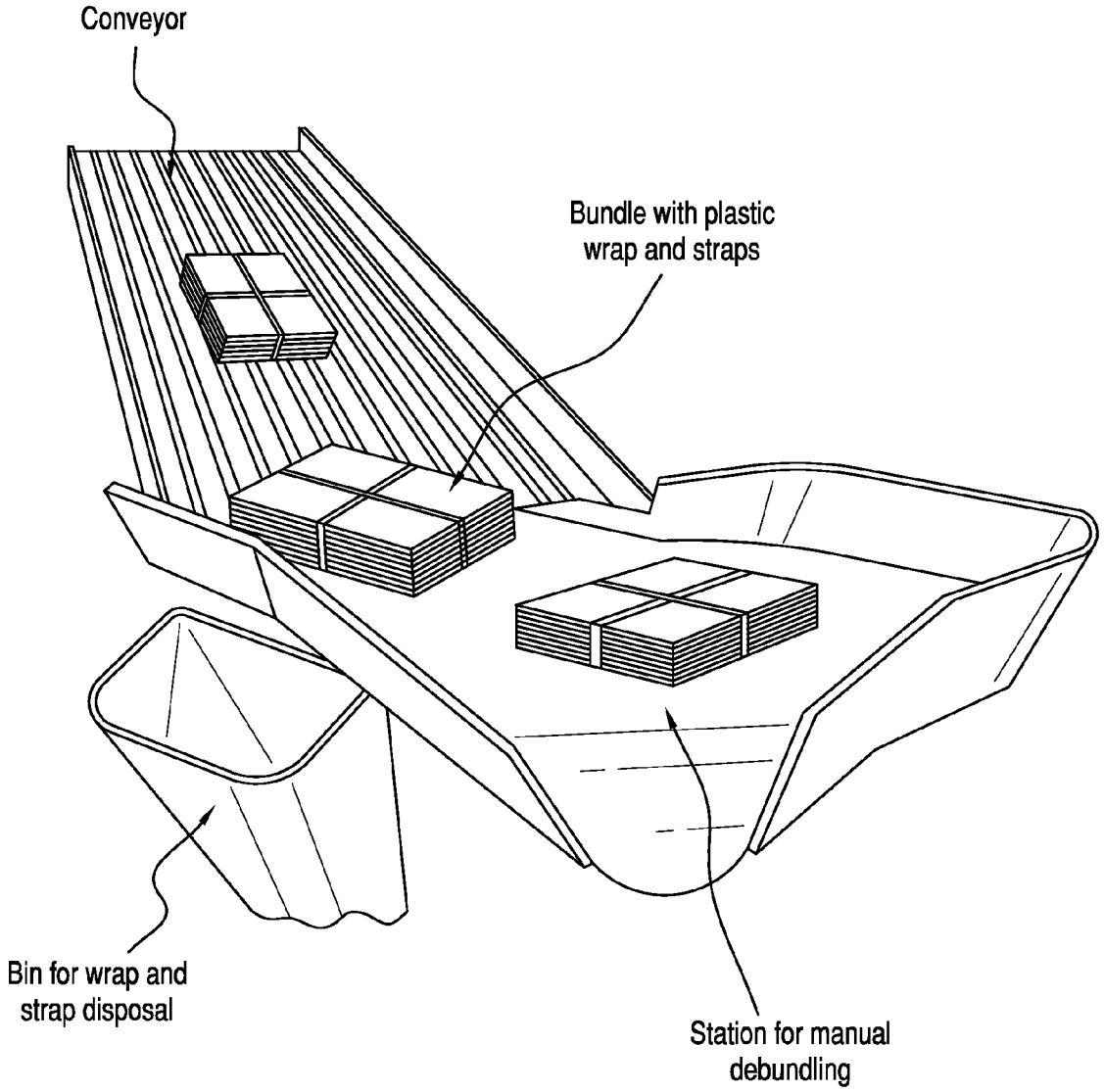
FIG. 2 (PRIOR ART)
FIG. 2 is a perspective view of a prior art manual debundling system.

In various embodiments, a system is disclosed for removing wrapping and first and second straps from a bundle of items, the system comprising means for receiving a bundle of items to be sorted, the bundle being wrapped with a flexible, such as, but not limited to, plastic film and/or one or more straps.

In various embodiments, the means for receiving the bundle of items includes a first conveying mechanism positioned to convey a bundle from an external sorting system to a loading station.

In various embodiments, the loading station, after receiving the bundle from the first conveying mechanism, loads the bundle onto a supporting device where the wrap and strap cutting and removal operation commences. The loose bundle is then moved onto a second conveying mechanism for transferring the loose bundle away from the system for further processing. The conveying, loading, unbundling and subsequent transfer of the loose bundle is an automatic, continuous, and seamless process that takes advantage of gravity when moving the bundle between different processing steps. During the automatic transfer of the bundle between the different processing stages, the bundle is being continuously moved/transferred from a vertically higher position to a vertically lower position, such that at no time during the operation does the bundle need to be lifted or raised when moved from one processing step to another.

In various embodiments, the system comprises a supporting device configured to support an incoming bundle in a fixed position, the supporting device including first and second supporting plates, the first supporting plate being positioned adjacent the second supporting plate along a horizontal axis such that the incoming bundle rests on a portion of a top surface of the first supporting plate and a portion of a top surface of the second supporting plate, each of the first and second supporting plates including at least one hooking/gripping device attached to a respective side surface of a corresponding supporting plate, the hooking/gripping device on the side surface of the first supporting plate being offset relative to the hooking/gripping device on the facing side surface of the second supporting plate.

The system can further comprise a moving device configured to move the first and second supporting plates toward and away from each other along the horizontal axis, and a movable first cutting device positioned adjacent the supporting plates and configured to move in a direction perpendicular to the direction of movement of the supporting plates so as to make cuts in the wrapping and the first straps on a bottom surface of the bundle while the bundle is resting on the first and second supporting plates.

In various embodiments, after the wrapping and the first straps are cut, the moving device moves the first and the second supporting plates toward each other such that the hooking/gripping devices are close to each other. Then the moving device moves the first and the second supporting plates away from each other to increase the separation between the plates as the hooking/gripping devices grab the wrap and/or strap material until the bundle falls through the separation onto the holding device, wherein while moving, the first and second hooking/gripping devices grab and pull the cut edges of the wrapping free from the bundle. While the bundle is falling onto the holding device, the hooking/gripping device of the first supporting plate releases the wrapping so that the wrapping is supported by the hooking/gripping device of the second supporting plate. The hooking/gripping device of the second plate then releases the wrapping.

In various embodiments, the holding device includes a bag-like receptacle positioned underneath the first and second supporting plates to catch the falling bundle.

In various embodiments, the holding device is a lifting mechanism configured to lift a supporting surface from a first resting position to a second position along a vertical axis, where the second position is a position in which the lifting mechanism is underneath the bundle such that the bundle does not fall into a receptacle but gently drops onto the supporting surface.

In various embodiments, the holding device is further configured to deposit the items of the loose bundle onto a second conveying mechanism for further processing.

In various embodiments, the system can further comprise a centering mechanism to center the bundle on the supporting plates before the wrap and strap cutting and removal operation commences.

In various embodiments, the system can interfacing with an existing package sorting system or can be a stand-alone system.

In various embodiments, a package sorting system is disclosed for receiving a plurality of bundled packages to be sorted and shipped to different addresses, the package sorting system including an automated debundling system as described above and below.

The debundling system can also communicate downstream with one or more sorting stations for further processing of the debundled items before subsequent automatic address sorting.

In various embodiments, a method is disclosed for transporting a wrapped and strapped bundle to an automated unbundling system for debundling and for loading and transporting the debundled bundle from the automated debundling system to a sorting and processing system.

In various embodiments, a method is disclosed for interfacing a package sorting system with the debundling system.

In various embodiments, a method is disclosed for receiving a plurality of bundled packages to be sorted and shipped to different addresses, including an automated debundling method.

Figure 3A:
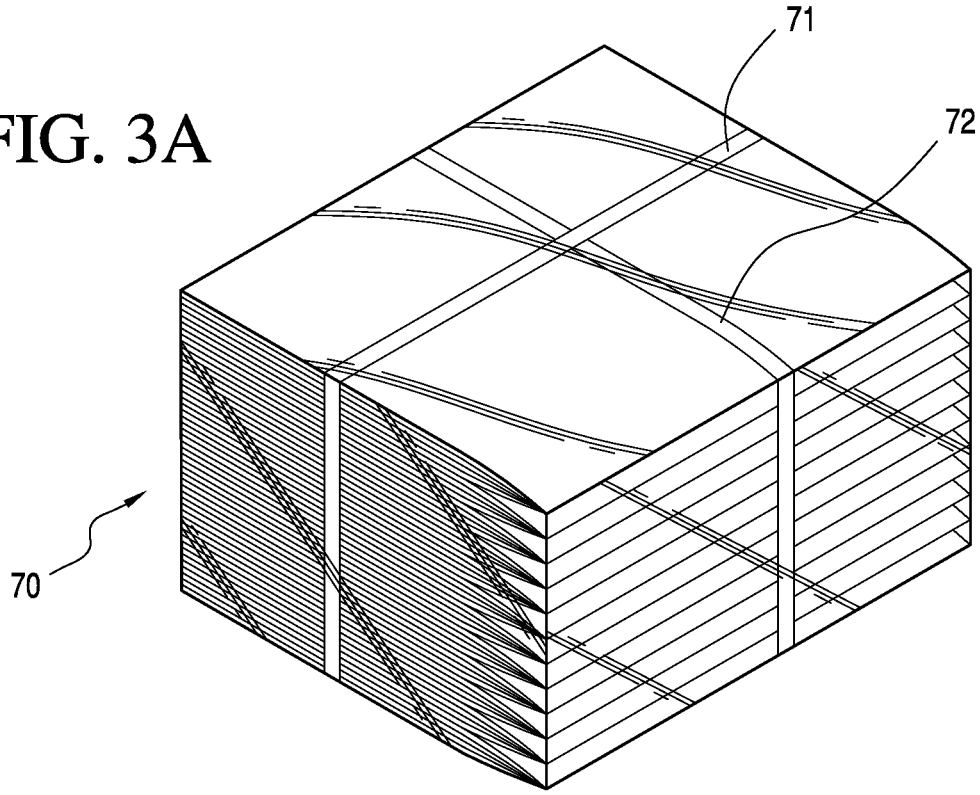
FIGS. 3A and 3B are top views of bundles including plastic wrappers and/or one or more straps.
Figure 3B:
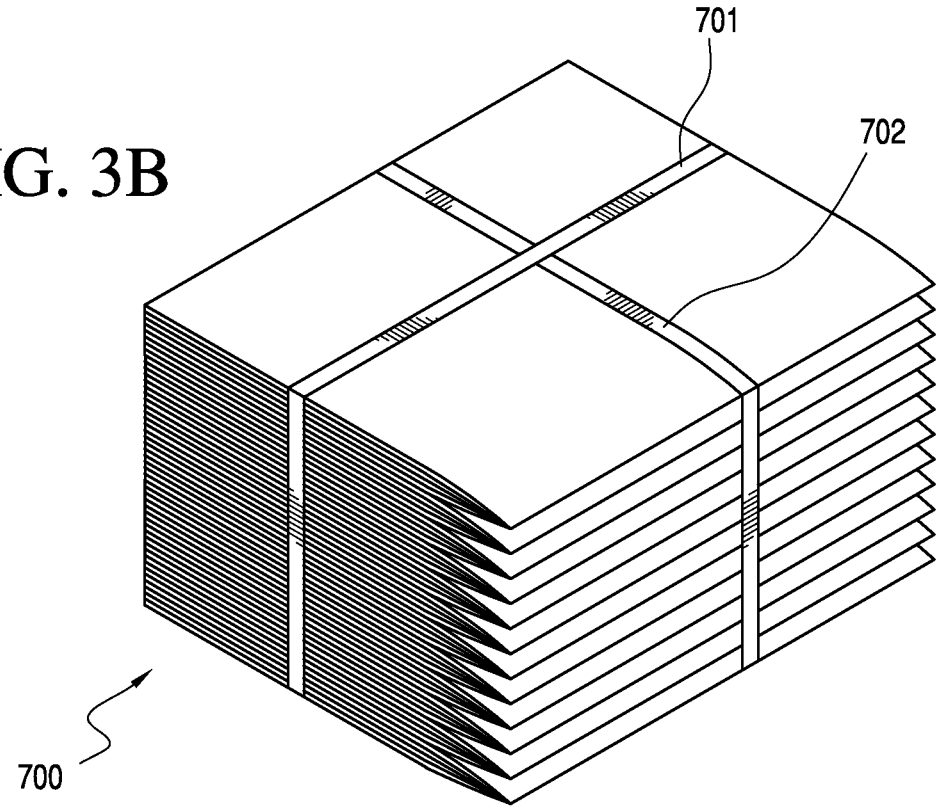
Figure 4:
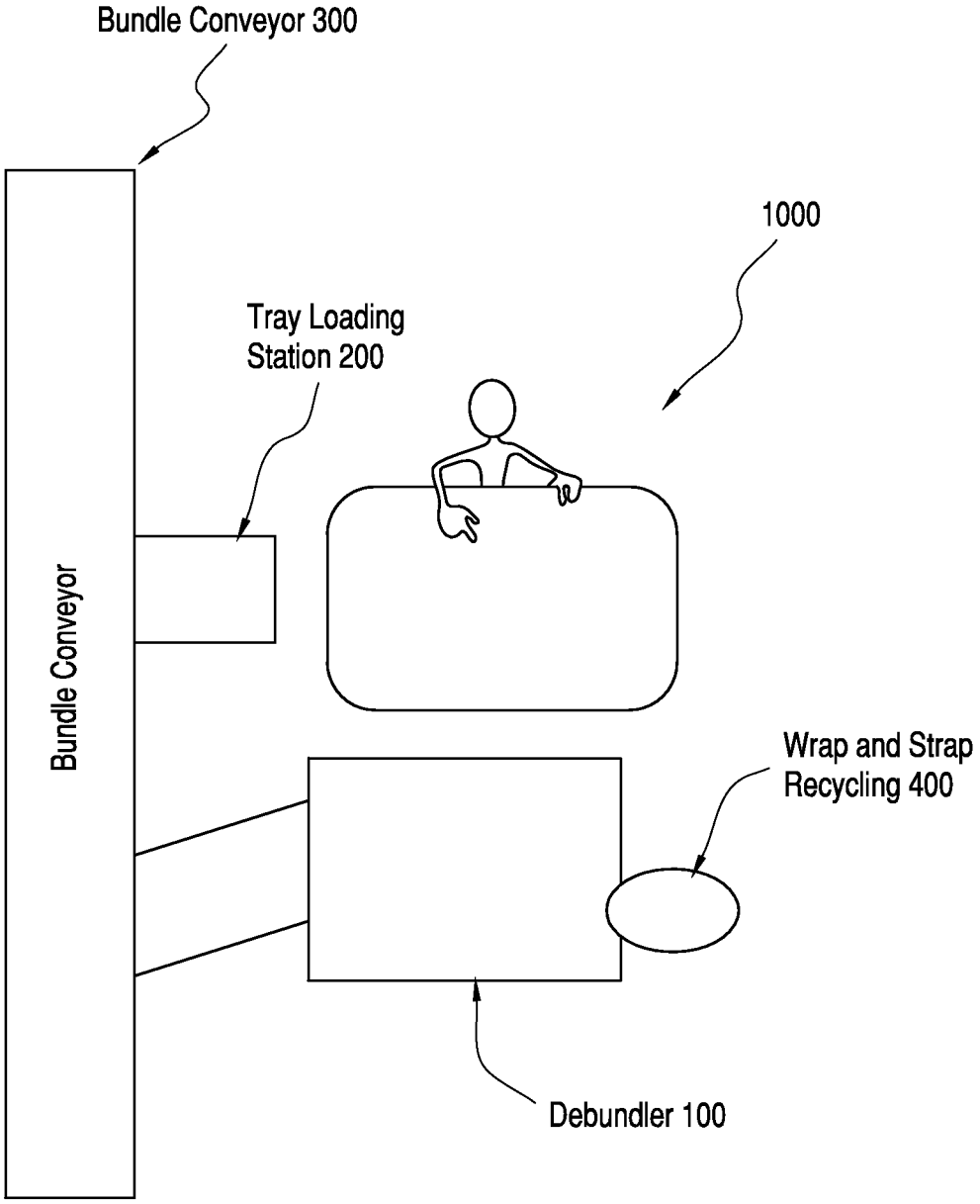
FIG. 4 is an illustration of a package sorting system interfaced with an automatic debundling system according to various embodiments.

FIG. 4 shows an embodiment of a debundling system 100 of the present invention interfacing with an existing sorting system 1000 typically located at a postal distribution center. The processing system 1000 includes a tray loading station 200 where an operator manually loads the bundled packages onto a bundle conveyor mechanism 300 for transporting the packages to the debundling system 100. The loading onto the conveyor 300 can also be done automatically. The bundled packages generally include one or more flat items such as but not limited to flat mail, catalogs, magazines, and brochures. These items are generally wrapped with a polymeric or other film wrapping material and/or strapped with a plastic or polymeric strap, string, or the like, in one or more directions. The straps could be positioned inside or outside of the wrapping. FIG. 3A shows an example of a bundle 70 with plastic wrapping 71 and plastic strap 72 underneath the wrapping 71. FIG. 3B shows a bundle 700 with two plastic straps 701 and 702.

The bundle conveyor 300 transports the bundles for further processing by the debundling system 100. The debundling system 100 automatically removes the outer wrappers and/or the straps. The debundled packages are then transported for further manual/automatic processing and sorting and subsequent delivery of the individual items to corresponding addresses.

Figure 5:
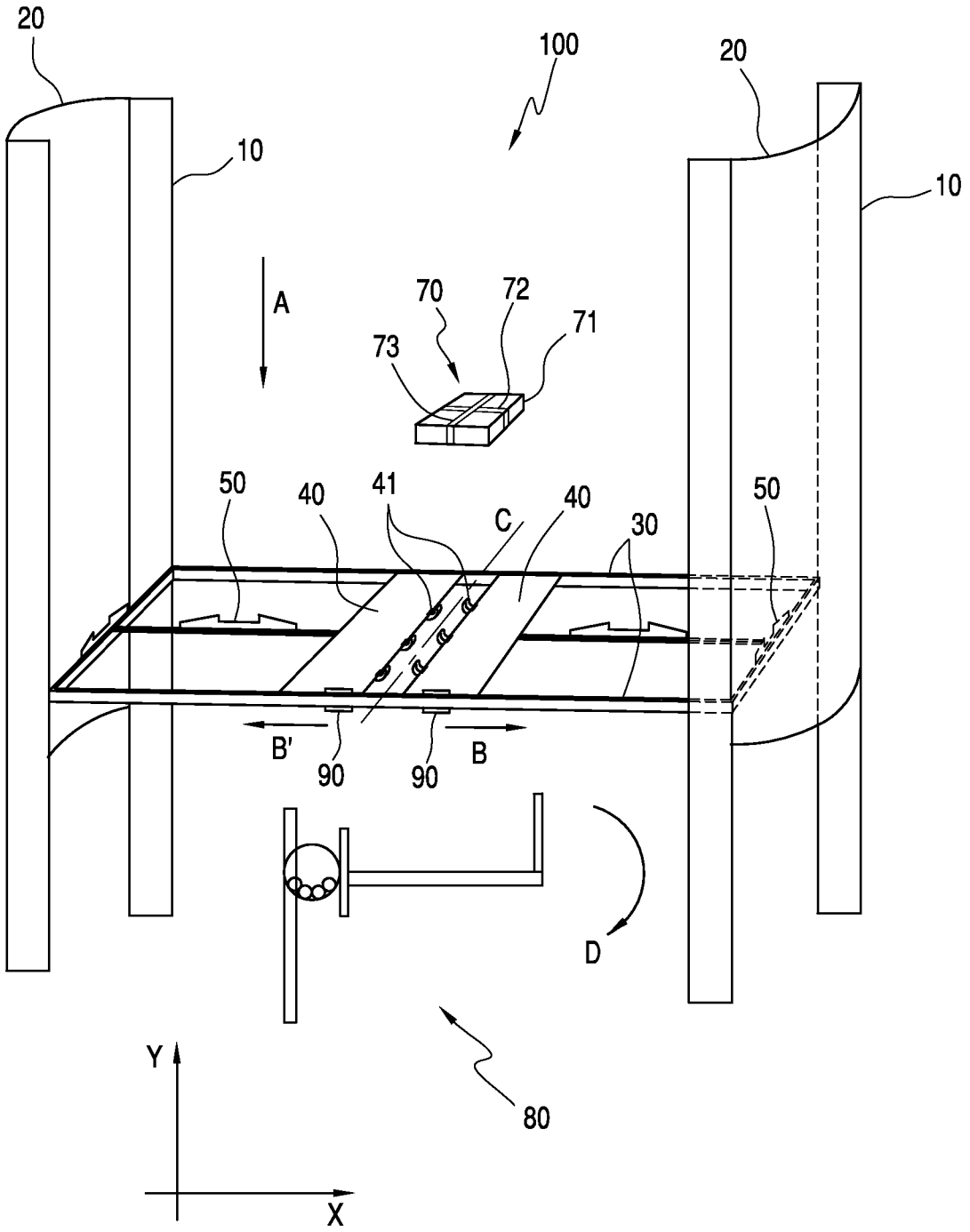
FIG. 5 is showing an automated debundling system according to an embodiment.
Figure 6:
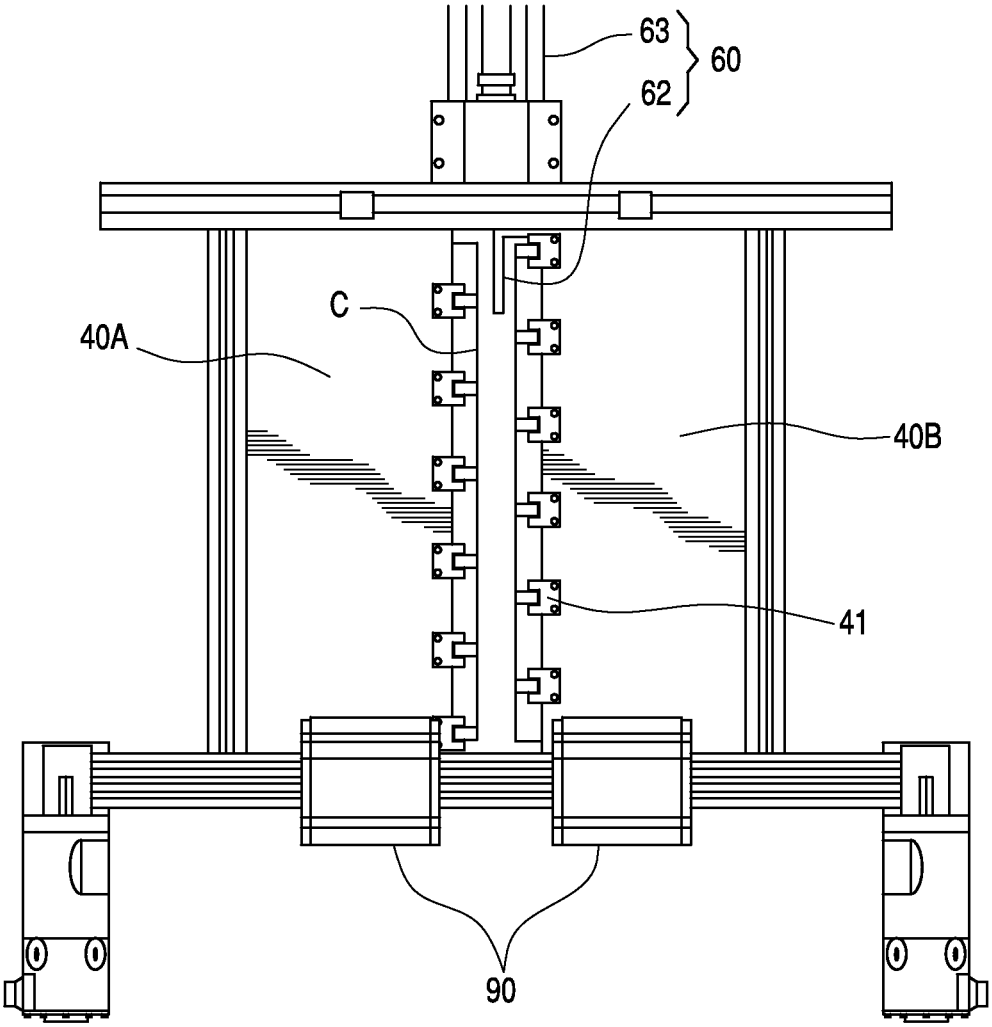
FIG. 6 is a top view of the debundling system shown in FIG. 5.

FIG. 5 shows a debundling system 100 according to an embodiment of the invention. The system 100 includes four substantially vertical supporting beams 10 supporting two substantially horizontal supporting arms 30. The supporting arms 30 are parallel to each other and are attached at respective ends to the vertical beams 10. Two supporting plates 40 are mounted (attached, connected, secured) to the parallel supporting arms 30 at respective opposing ends so that each plate 40 extends between the two parallel arms 30. The supporting plates 40 each have respective substantially flat upper surfaces. Together, the supporting plates 40 form a supporting surface for receiving and securely holding an incoming bundle 70. The supporting plates 40 are mounted to the supporting arms 30 so that upper surfaces of the supporting plates 40 face a bottom surface of the incoming bundle 70. The supporting plates 40 are attached to the supporting arms 30 using brackets so that they can separately be moved along the length of the supporting arms 30 in a horizontal direction B and B' using powered actuators 90 such as pneumatic cylinders, for example. The actuators 90 are operably connected to a controlling system (shown in FIG. 6) and provide movement of the supporting plates 40 along the horizontal direction. The supporting plates 40 can be moved toward and away from each other along the horizontal axis. During the move, a side surface of the first supporting plate 40A faces a side surface of the second supporting plate 40B.

Figure 7:
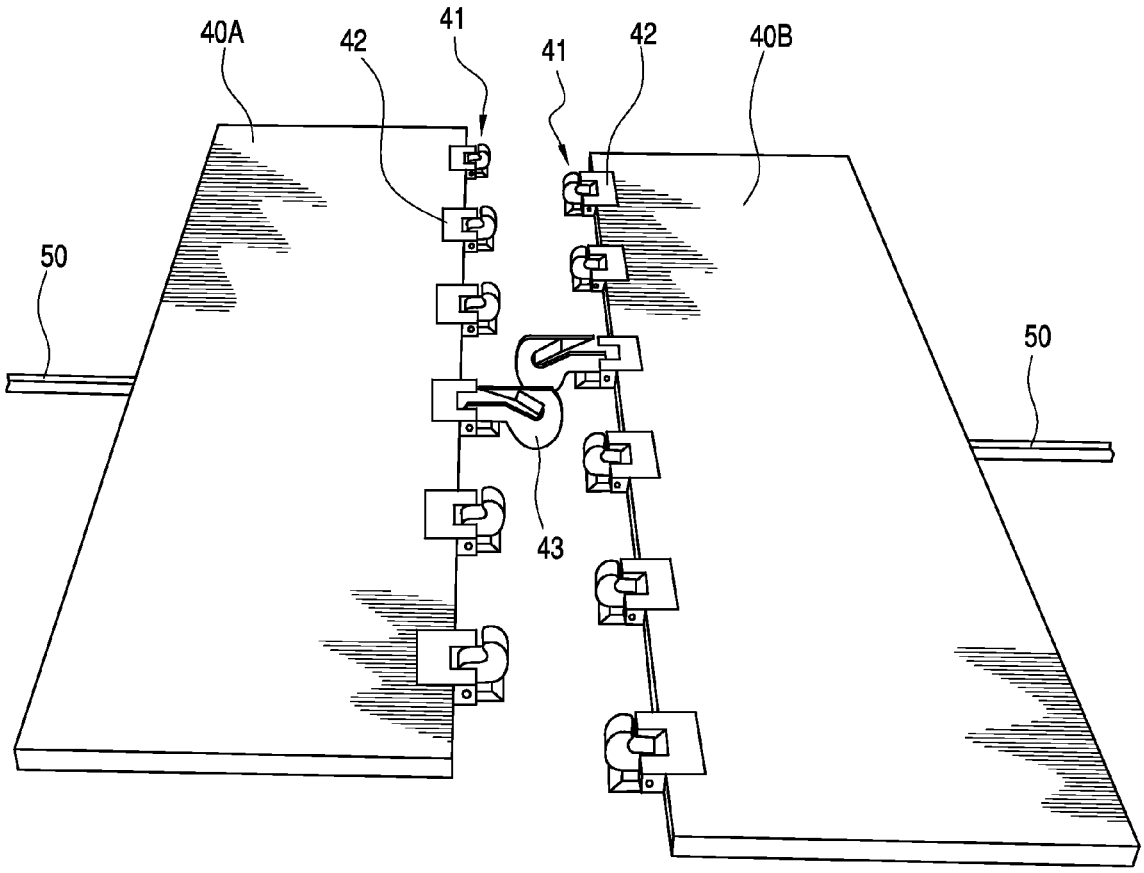
FIG. 7 is a perspective view of a first and second supporting plates according to various embodiments.
Figure 8:
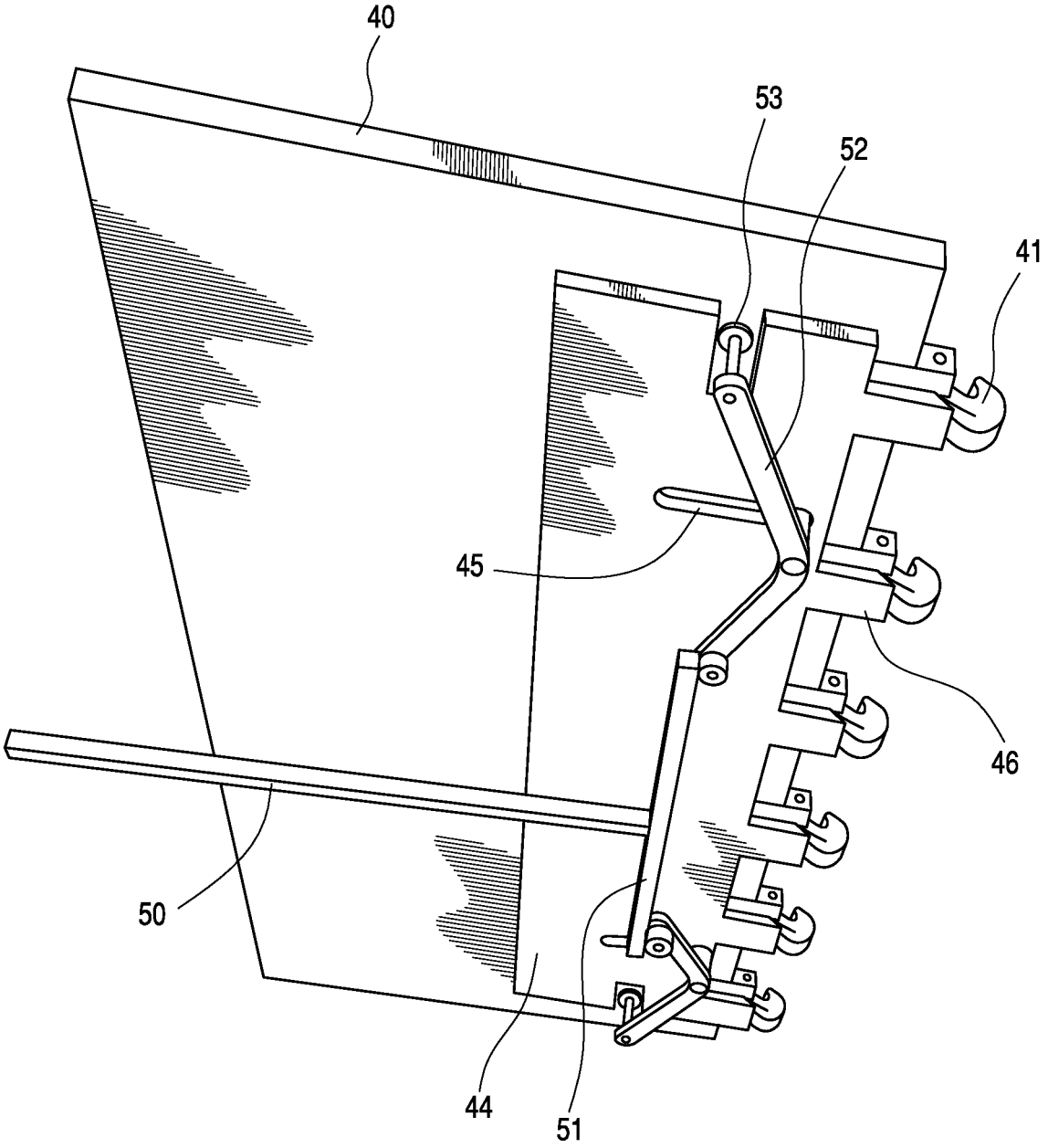
FIG. 8 is a bottom view of a first supporting plate.
Figure 9A:
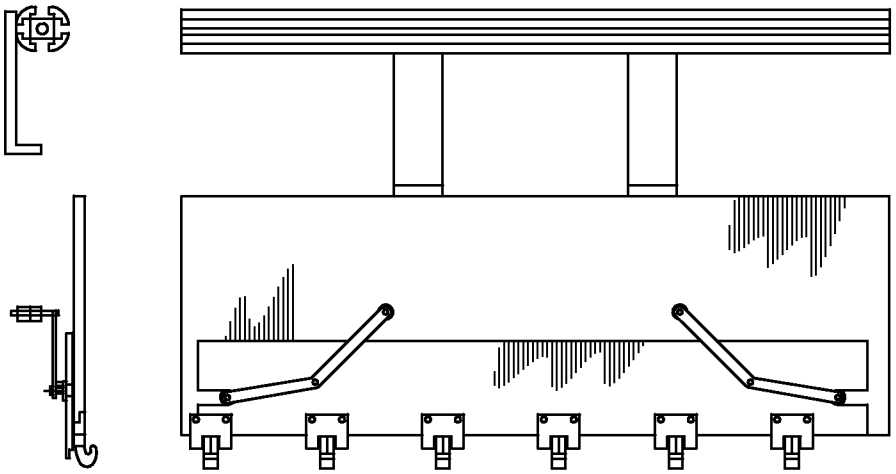
FIGS. 9A and 9B are bottom views of a first supporting plate.
Figure 9B:
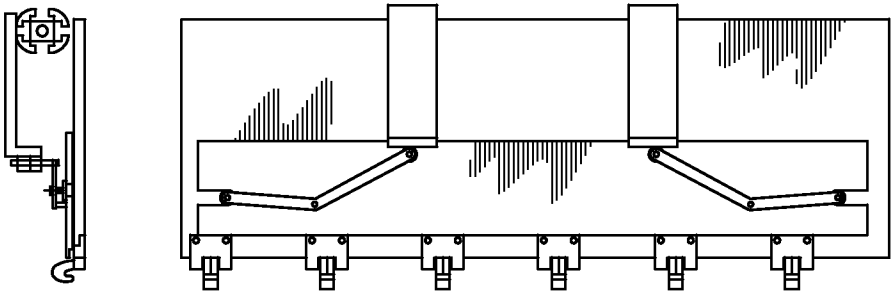
Figure 10A:
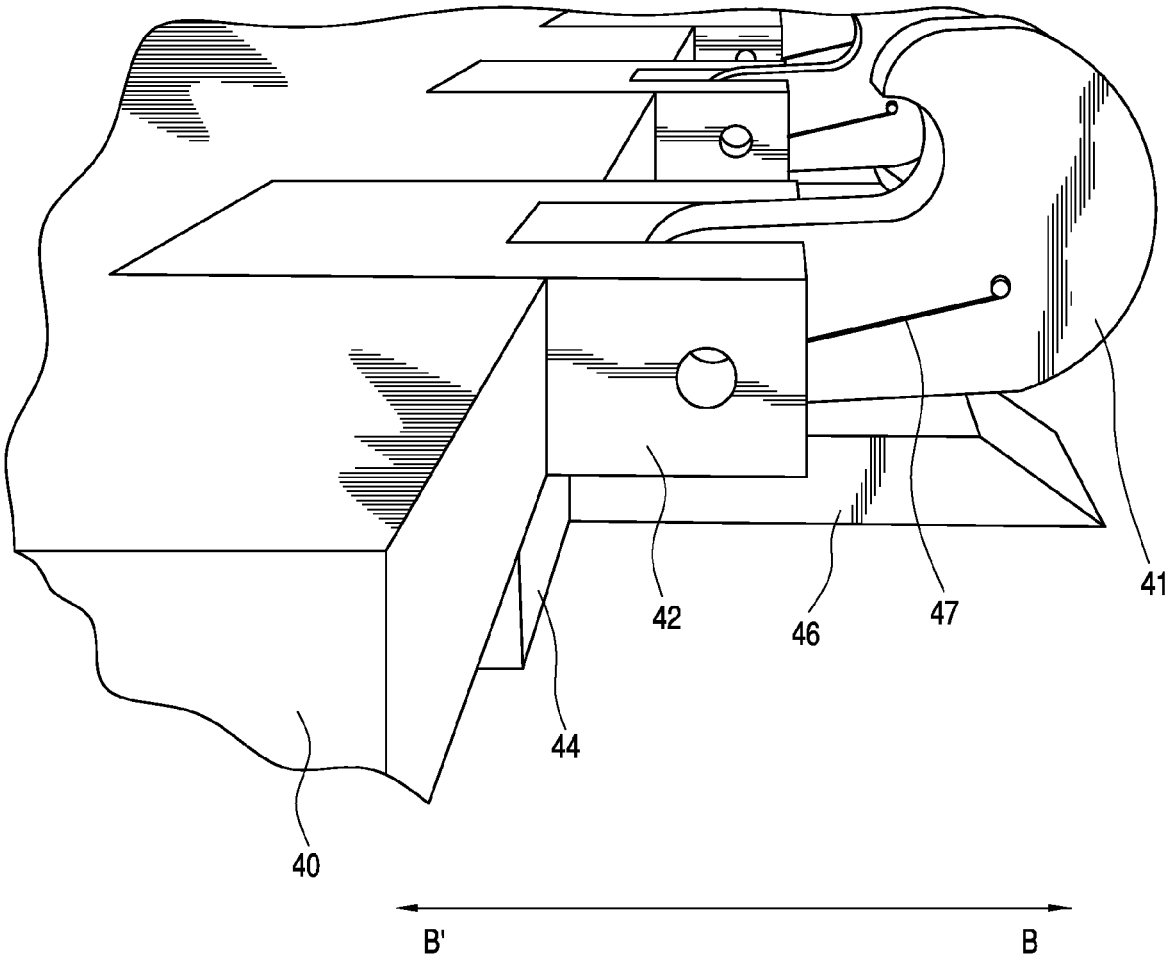
FIGS. 10A and 10B illustrate the movement of a hooking device.
Figure 10B:
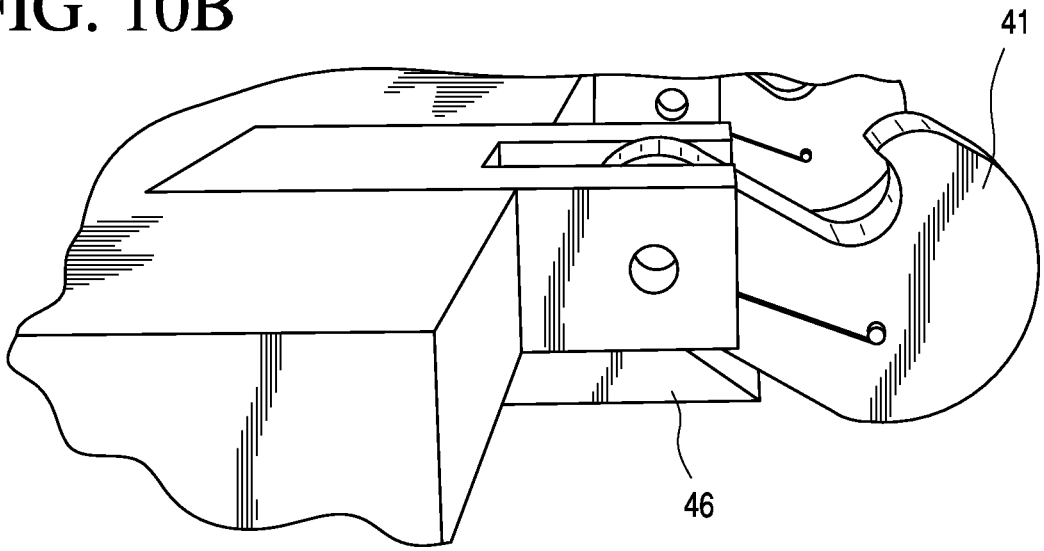

Each of the supporting plates 40 has a plurality of hooking/gripping devices 41 mounted lengthwise on respective facing side surfaces of the supporting plates 40 (shown in detail in FIG. 7). The hooking devices 41 are aligned along the respective side surfaces of the supporting plates 40 at regular intervals so that the hooking devices 41 of the first supporting plate 40A are shifted relative to the hooking devices 41 of the second supporting plate 40 in the lengthwise direction. The hooking devices 41 are pivotably mounted on each of the supporting plates 40 using brackets 42 (shown in FIG. 7) so that a horizontally extending curved gripping portion (hook) of the hooking device 41 of the first supporting plate 40A is facing a curved gripping portion (hook) of the hooking device 41 of the second supporting plate 40B. The hooking devices 41 can be pivoted from a first position where the curved gripping portions are slightly above the upper surface of the supporting plate 40 to a second position where the curved gripping portions are below the upper surfaces of the supporting plates 40 (see FIGS. 7, 10A and 10B). The supporting plates 40 can be moved toward each other until the gripping portions of the hooking devices 41 appear to be intertwined with each other when looking at it from the top (see FIG. 6). At this point there is still a slight separation between the supporting plates 40 which accounts for the horizontally extending length of the hooking devices. This slight separation between the supporting plates 40 exposes a bottom surface of the bundle 70 when the bundle is loaded onto the upper surfaces of the supporting plates 40 (when looking at it from the bottom).

The incoming bundle 70, which can have a thin film polymeric wrapping 71 and/or a plurality of straps 72 and 73, can be loaded either manually or automatically onto the upper surfaces of the supporting plates 40. The bundle 70 is loaded onto the supporting plates 40 by moving the bundle 70 either manually or automatically in a direction A perpendicular to the upper surfaces of the supporting plates 40. Before loading the bundle 70 onto the supporting plates 40, the supporting plates 40 are positioned close to each so that the hooking devices 41 are intertwined and so that the curved gripping portions of the hooking devices 41 are positioned slightly above the upper surfaces of the supporting plates 40. The bundle 70, when loaded, rests in a fixed position on a portion of an upper surface of the first supporting plate 40A and a portion of an upper surface of the second supporting plate 40B. Because in this resting position the hooking devices 41 are positioned in the first position in which the curved gripping portions of the hooking devices 41 are above the upper surfaces of the supporting plates 40, the bundle 70 rests on the curved gripping portions. The system 100 may further include an additional support mechanism (not shown) to ensure that the bundle 70 is securely positioned in a predetermined position on the supporting plates 40 and that it will not shift during the cutting and unwrapping process.

Figure 13:
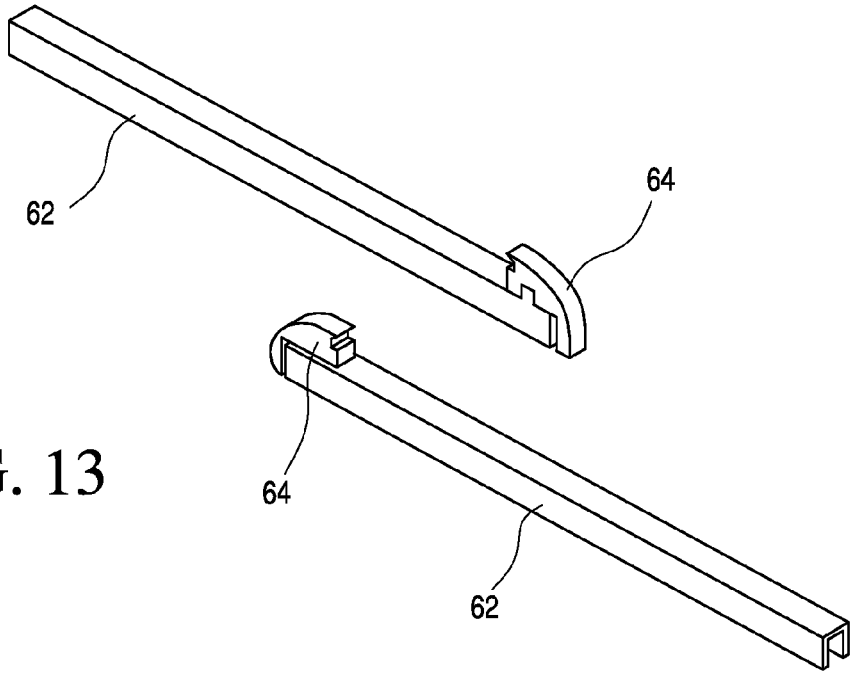
FIG. 13 illustrates a cutting device according to an embodiment.

A cutting device 60 (shown in FIGS. 6 and 13) positioned on one of the supporting arms 30 includes a cutter 64 attached (mounted, secured, connected) to an end portion of a cutter carrier 62, which may be a substantially elongated rod. The carrier 62 is securely attached to a cutter mover 63, which pushes and retracts the carrier 62 so that the carrier 62 slides the cutter 64 underneath the supporting plates 40 in a direction C which is perpendicular to the direction of movement of the supporting plates 40. The cutting device 60 is positioned so as to move the cutter 62 along a length of the separation between the supporting plates 40 so as to cut the wrapping 71 and the first straps 72 along the exposed bottom surface of the bundle 70 when the bundle is fixedly positioned on the supporting plates 40. The cutting device 60 is configured to move the carrier 62 in a first instance underneath the supporting plates 40 from the cutter mover 63 until it reaches a position which is opposite the cutter mover 63 and to retract the carrier 62 along the same path in a second instance. In one embodiment, the cutter 64 is shaped so that it cuts the wrapping 71 and straps 72 during the retracting movement of the carrier 61. In another embodiment, the cutter 64 is shaped so as to cut the wrapping 71 and the straps 72 during the first instance when the carrier 62 is moving away from the cutter mover 63.

The cutter 64 further includes a pinching section (not show) which allows for pinching, holding and carrying of the cut straps 72 back to the cutter mover 63. The cut straps 72 can be manually or automatically removed from the cutter 64 after the cutting and de-wrapping operation.

After the wrapping 71 and the straps 72 are cut by the cutting device 60, the supporting plates 40 are first moved toward each other and then moved away from each other along the horizontal axis so that the first supporting plate 40A moves in direction B' and the second supporting plate 40B moves in direction B. While the supporting plates 40 are moving apart, the hooking devices 41 with their respective curved gripping portions grip respective edges of the now cut wrapping on the bottom of the bundle, and as the supporting plates 40 move further apart, the hooking devices 41 grab and carry the wrapping further away from the bottom of the bundle 70 until the separation between the plates is large enough that the bundle 70 falls due to gravity.

As the bundle falls through the separation between the supporting plates 40, the wrapping 71 is completely separated from the bundle 70 and it is gripped on one end by the hooking devices 41 of the first supporting plate 40A and at the other end by the hooking devices 41 of the second supporting plate 40B. While the bundle 70 is falling, the curved gripping portions of the hooking devices 41 of the first supporting plate 40 are pivoted from the first position to the second position to release the wrapping 71. After this, the wrapping 71 is held only by the hooking devices 41 of the second supporting plate 40B.

The wrapping 71 can then be either manually removed from the hooking devices 41 of the second supporting plate 40B, or the hooking devices can be pivoted from the first position to the second position to automatically release the wrapping 71. The wrapping can be released into a recycling or trash bin.

Figure 14:
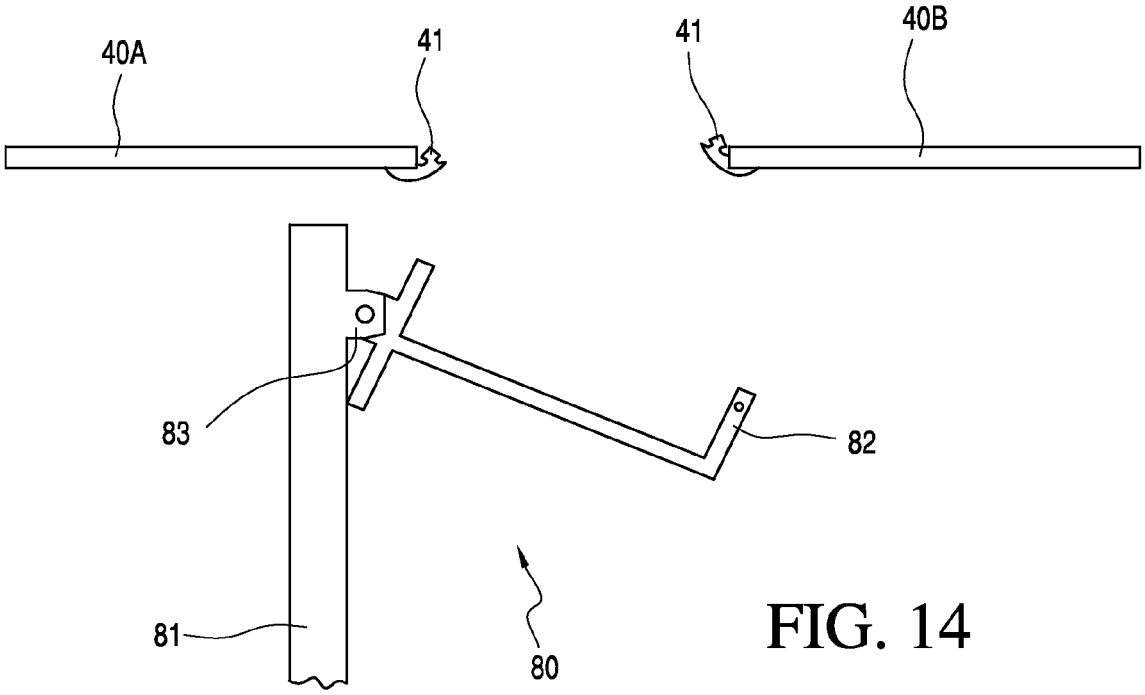
FIG. 14 illustrates a holding device positioned below a first and second supporting plates according to an embodiment.
Figure 15:
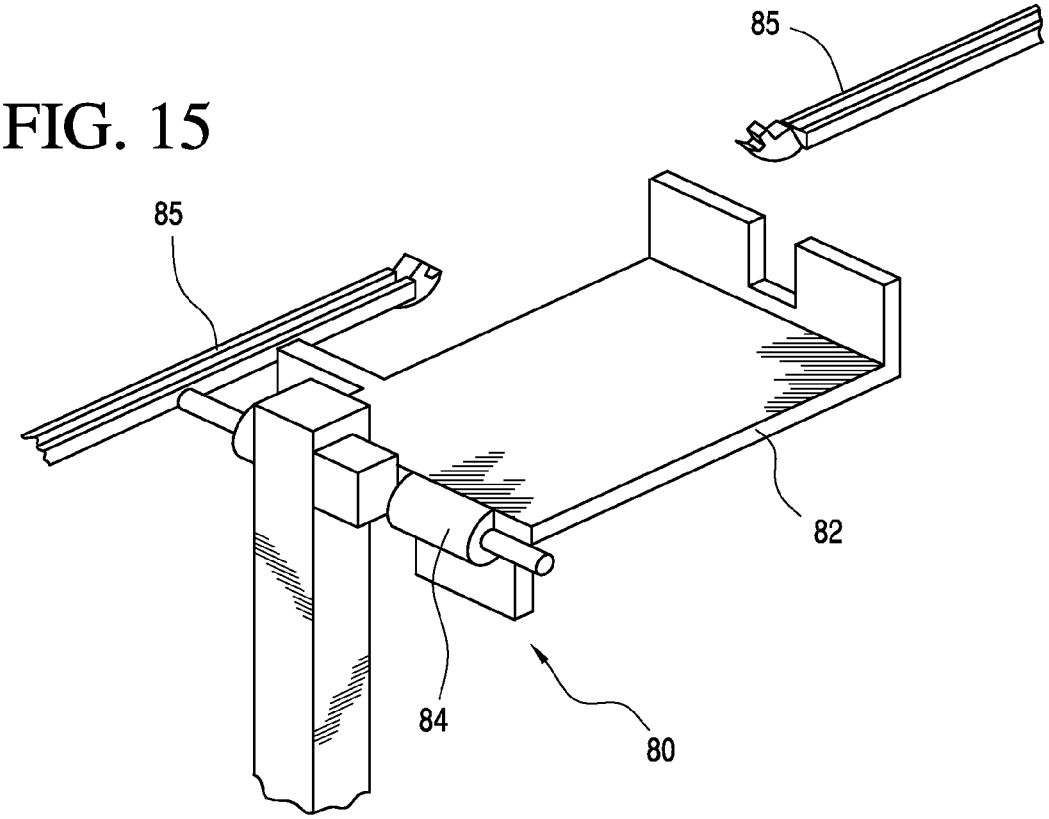
FIG. 15 illustrates the holding device of FIG. 14 is a first position.
Figure 16A:
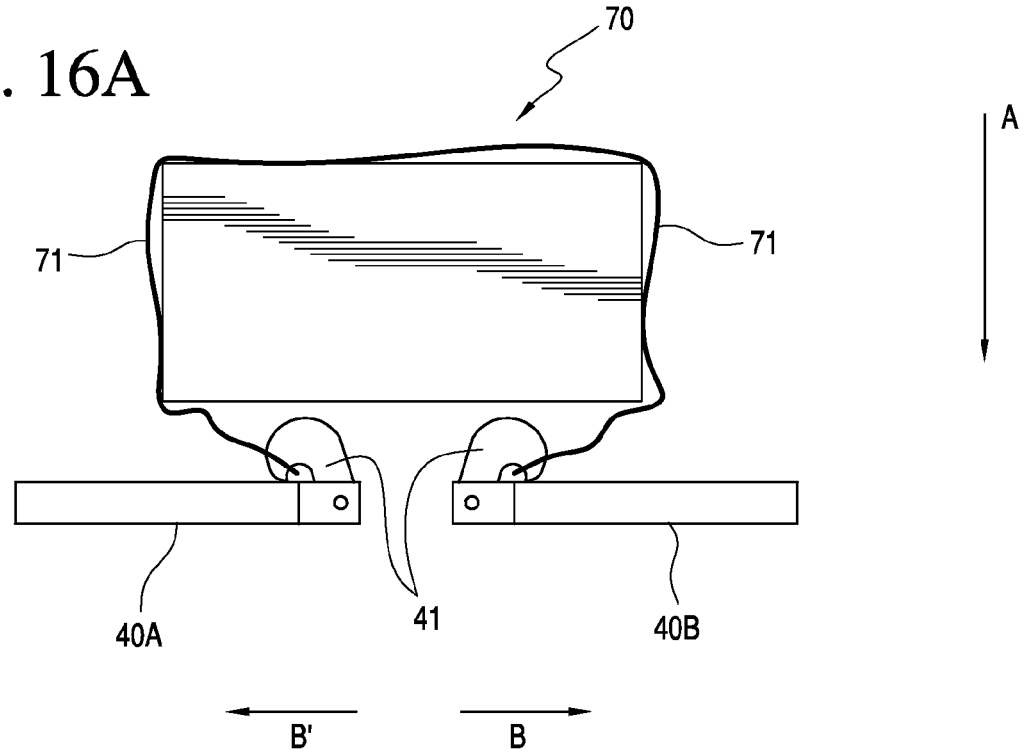
FIGS. 16A-16D illustrate a method of cutting and removing a wrapper and straps from a bundle according to an embodiment.
Figure 16B:
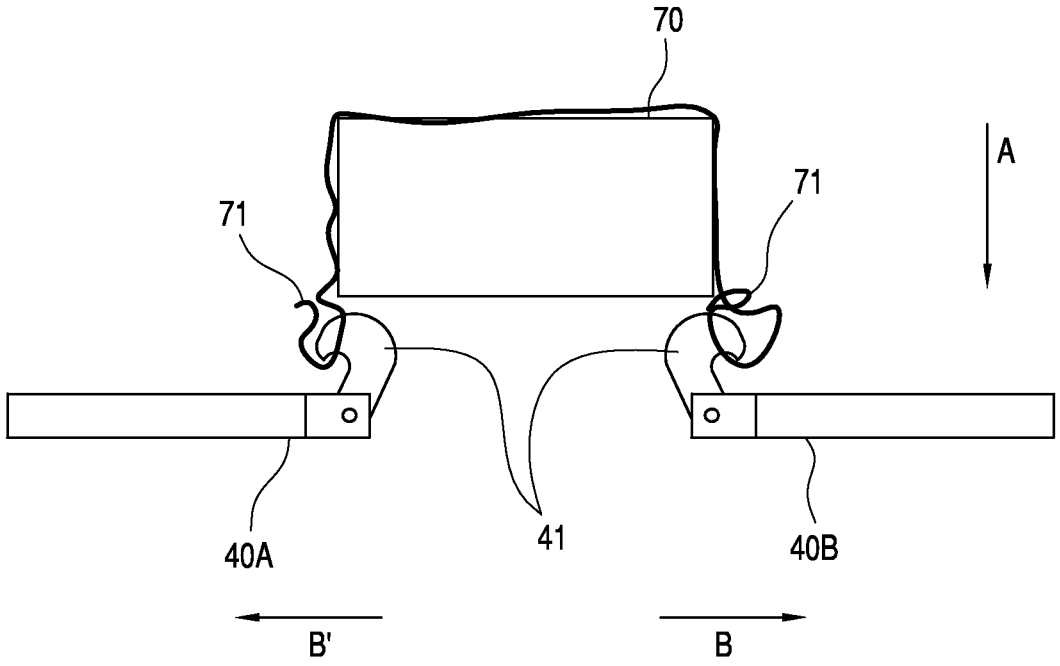
Figure 16C:
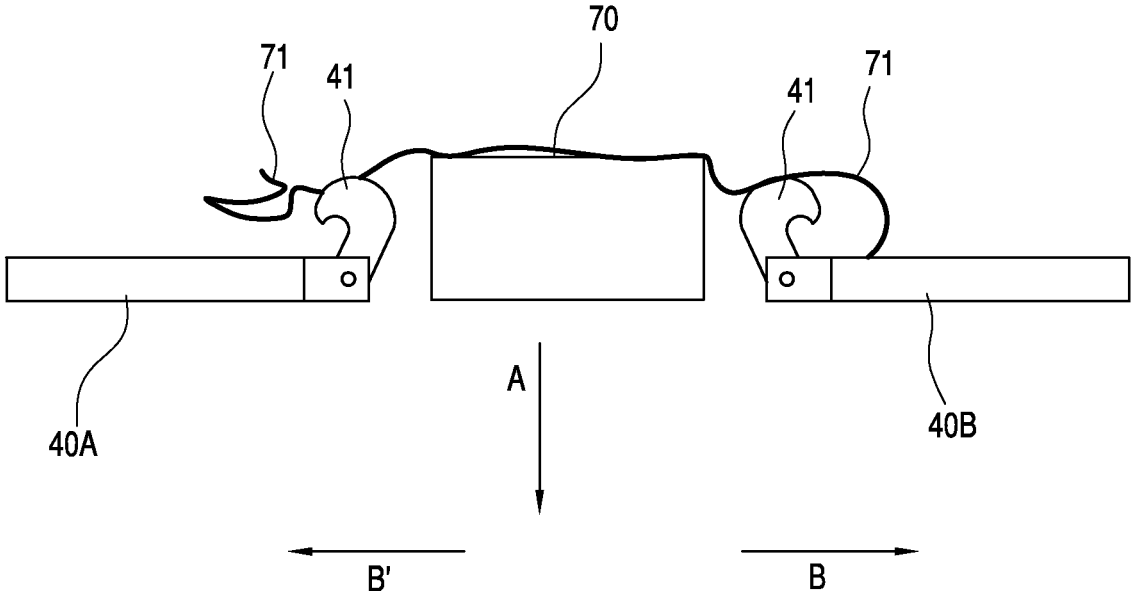
Figure 16D:
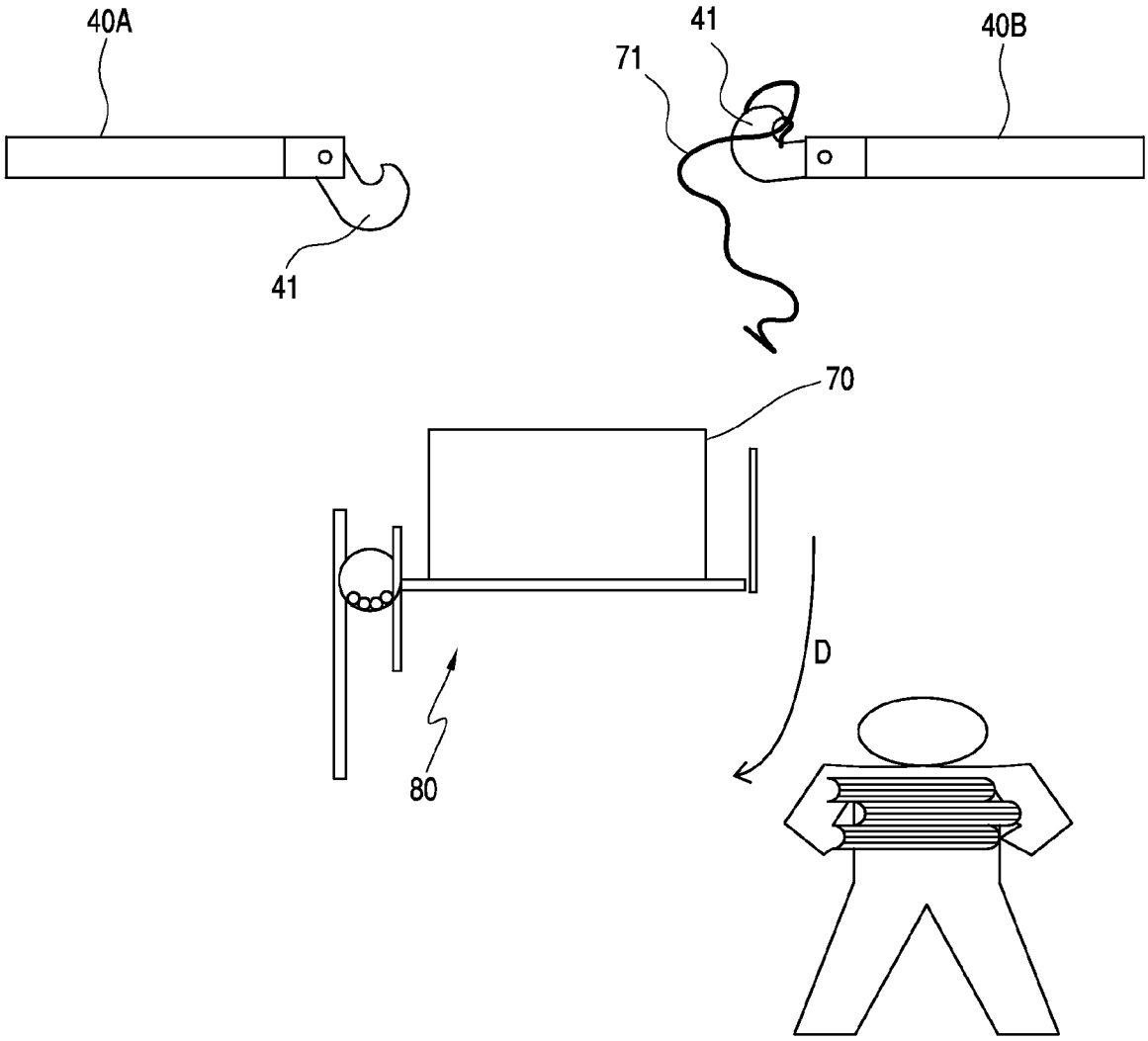

The system 100 may also include a holding device 80 into which the now wrap and strap free (i.e., loose) bundle 70 can fall. The holding device 80 can be a hammock or bag-like container attached to either the supporting beams 10 or the supporting arms 30. The holding device can also be a free-standing holding device 80 movably attached to the supporting beams 10 having a receptacle 82 pivotably attached to a supporting structure 81 through a pivoting mechanism 83 and 84, as shown in FIGS. 14 and 15. The unbundled items fall into the receptacle 82 while the receptacle 82 is positioned in a first position (shown in FIGS. 5 and 15). The debundled items caught in the receptacle 82 can then be automatically transferred onto a conveying mechanism for further processing and sorting by pivoting the receptacle 82 in direction D to a second position (shown in FIG. 14). The holding device 80 may also be movably attached to supporting beams 10 via supporting arms 85 (shown in FIG. 15).

In another embodiment, at least one of the supporting plates 40 can include a second cutting device 43 positioned on its side surface and adjacent the hooking devices 41, the second cutting device 43 being configured to cut the second straps 73 on a bottom surface of the bundle 70 while the first and second supporting plates 40 are moved away from each other. These second straps 73 can be straps that are positioned in a direction perpendicular to the first straps 72.

In various embodiments, each of the supporting plates 40 may include second cutting devices 43 as shown in FIG. 7 so that a first cutter is positioned on the first supporting plate 40A and a second cutter is positioned on the second supporting plate 40B.

Figure 12:
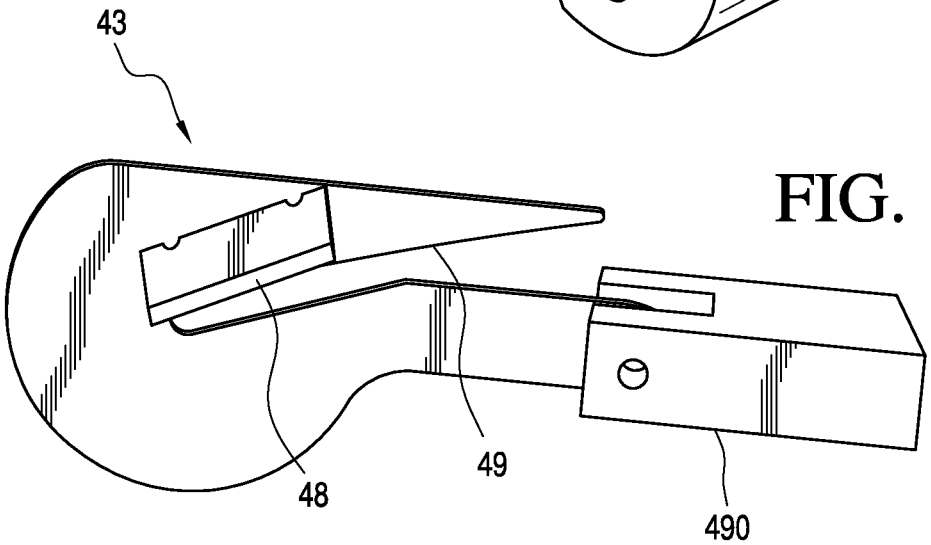
FIG. 12 illustrates a cutting device according to an embodiment.

In various embodiments, each of the second cutting devices 43 include brackets 490 for secure mounting of the cutting devices 43 on the supporting plates 40, a curved grabbing and pinching portion 49 which is shaped so as to grab, pinch and hold straps 73 after cutting the straps 73 with a cutting blade 48 until the straps 73 can be safely manually or automatically removed from the cutting devices 43 (see FIG. 12).

The system 100 can further include shields 20, such as light curtains, for example, to protect an operator from accidentally entering and touching an element inside a safety zone of the system, the safety zone including an area where the cutters are cutting the straps and wrapping. The system 100 may also include sensors and detectors to detect a movement of the operator around the safety zone and to automatically shut off the entire system or just a portion of the cutting and/or de-wrapping operation if presence of an operator is detected in the safety zone.

Figure 11:
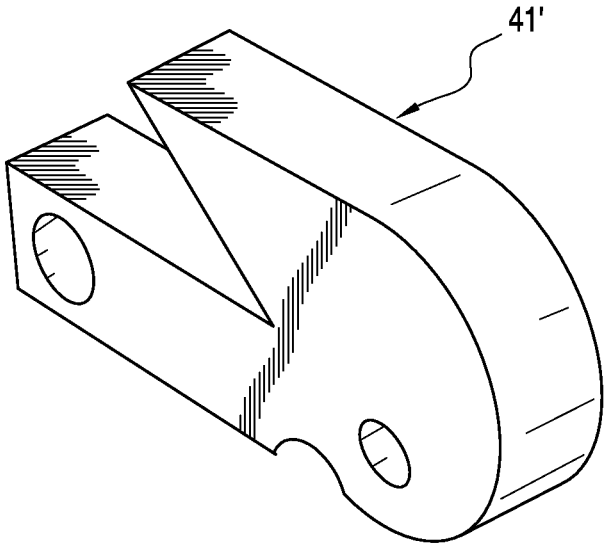
FIG. 11 shows an alternative hooking device.

FIGS. 8-10B show details of the supporting plates 40 and the operation of the pivoting movement of the hooking devices 41. The supporting plate 40 includes on a bottom surface thereof a bottom plate 44 movably mounted to the supporting plate 40 so that when the supporting plate 40 moves in a horizontal direction B', a moving arm 50 pushes on a second moving arm 51 which slides a connecting arm 52 in grooves 45 until extending portions 46 of the bottom plate 44 push on the curved gripping portions of the hooking devices 41 to pivot from a second position shown in FIG. 10B to a first position shown in FIG. 10A. The pivoting of the hooking devices 41 can be realized using torsion springs 47 or similar mechanisms. The reverse motion allows for the extending portions 46 of the bottom plate 44 to pull away from the curved gripping portions of the hooking devices 41 and therefore pivot the hooking devices 41 from the first position shown in FIG. 10A to the second position shown in FIG. 10B. The pivoting movement of the hooking devices 41 is also shown in FIGS. 9A and 9B. The combined movements of the above described elements to pivot the hooking devices 41 is designed so that the angle of the hooking device 41 is controlled and so that the hooking device 41 is allowed to move to the release position to release the plastic wrapping. An alternative design for a hooking device 41' is shown in FIG. 11. The hooking device 41 is designed to catch the plastic wrapping but also to minimize the damage to the underlying bundle during the pivoting the grapping, and the moving of the wrapping.

FIGS. 16A-16D illustrate the controlled timing of the automated debundling operation. In a first step the bundle 70 is loaded onto a debundling system so that it rests on a portion of a top surface of the first supporting plate 40A and a portion of a top surface of the second supporting plate 40B, each plate including hooking devices 41 pivoted into a first position. There is a slight separation between the first and second supporting plates 40 to expose a portion of a bottom surface of the bundle 70, the first and second supporting plates 40. The sliding of the first cutting device 60 along the exposed bottom surface of the bundle 70 is next, whereby the cutting blade 62 of the first cutting device 60 cuts the wrapping 71 and the first straps 72 of the bundle 70 along the cutting direction C without damage to the items contained in the bundle. Next, the supporting plates 40 are moved first toward each other to overlap and position the hooks at the cut location, and then moved away from each other along the horizontal axis to increase the separation between the plates 40. While the supporting plates 40 are moved apart, the second cutter 43 cuts and pinches straps 73 and the hooking devices 41 grab and move respective ends of the cut wrapping 71 until the bundle 70 falls through the separation into a holding device. While the bundle 70 is falling through the separation, the hooking device 41 of one of the supporting plates pivots its curved gripping portion from the first position to the second position to release the wrapping 71. The hooking devices 41 of the second supporting plate 40B maintain their first position to hold the wrapping 71. The wrapping 71 can then be disposed of by pivoting the hooking devices 41 of the second supporting plate 40B into the second position to release the wrapping 71 into a trash or recycling bin. The items in the unwrapped bundle 70 which are now gathered in the holding device 80 can be manually removed by an operator for further sorting or can be automatically transferred to a conveying mechanism for further processing. The plastic straps 72 and 73 may also be manually removed from the first and second cutting devices and recycled.

Figure 17A:
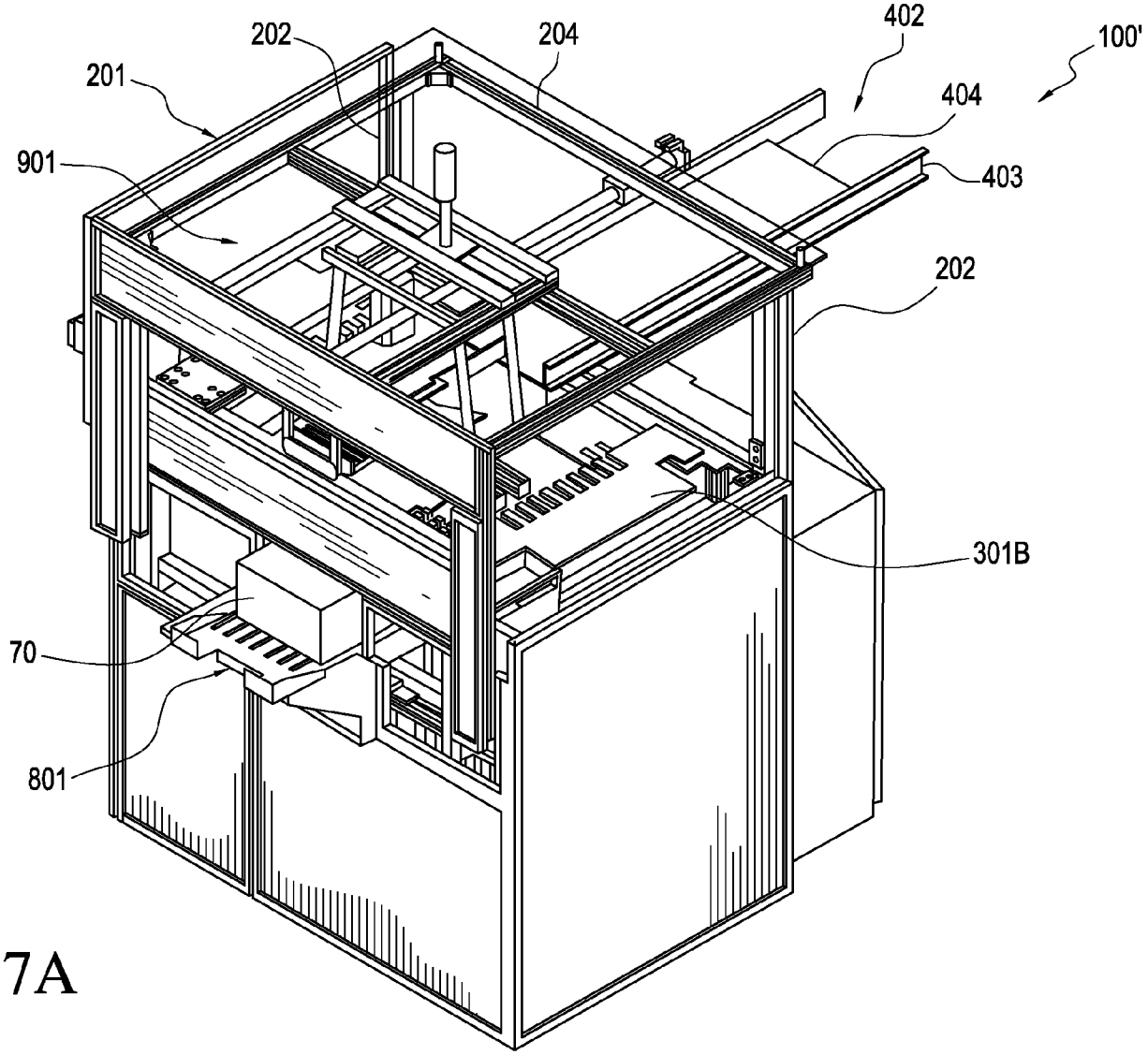
FIG. 17A is showing an automated debundling system according to another embodiment.
Figure 17C:
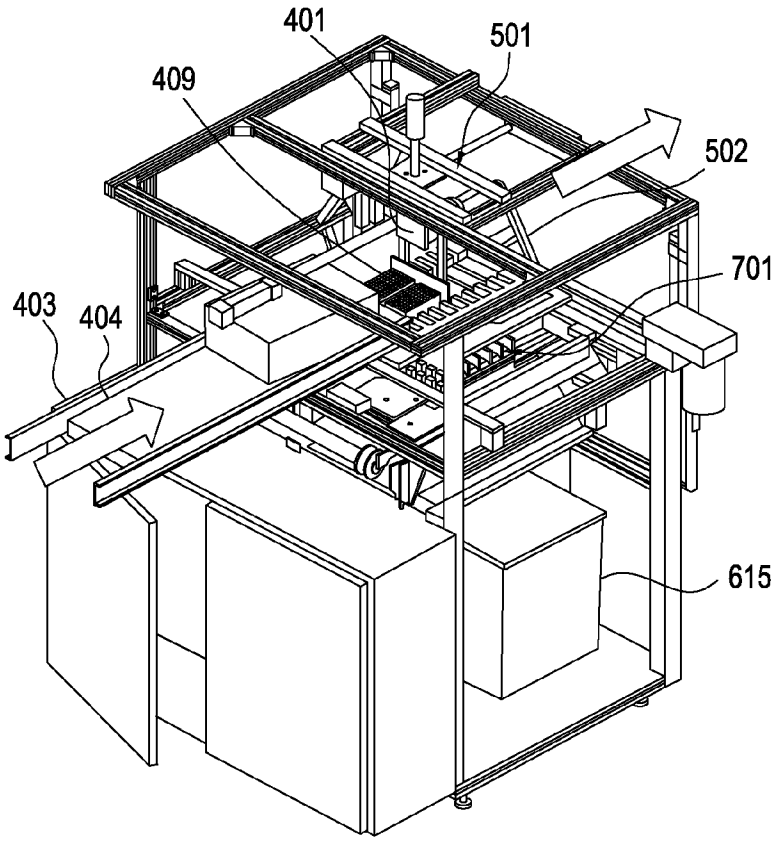
FIG. 17C is a rear view of the automated debundling system of FIG. 17A.
Figure 17B:
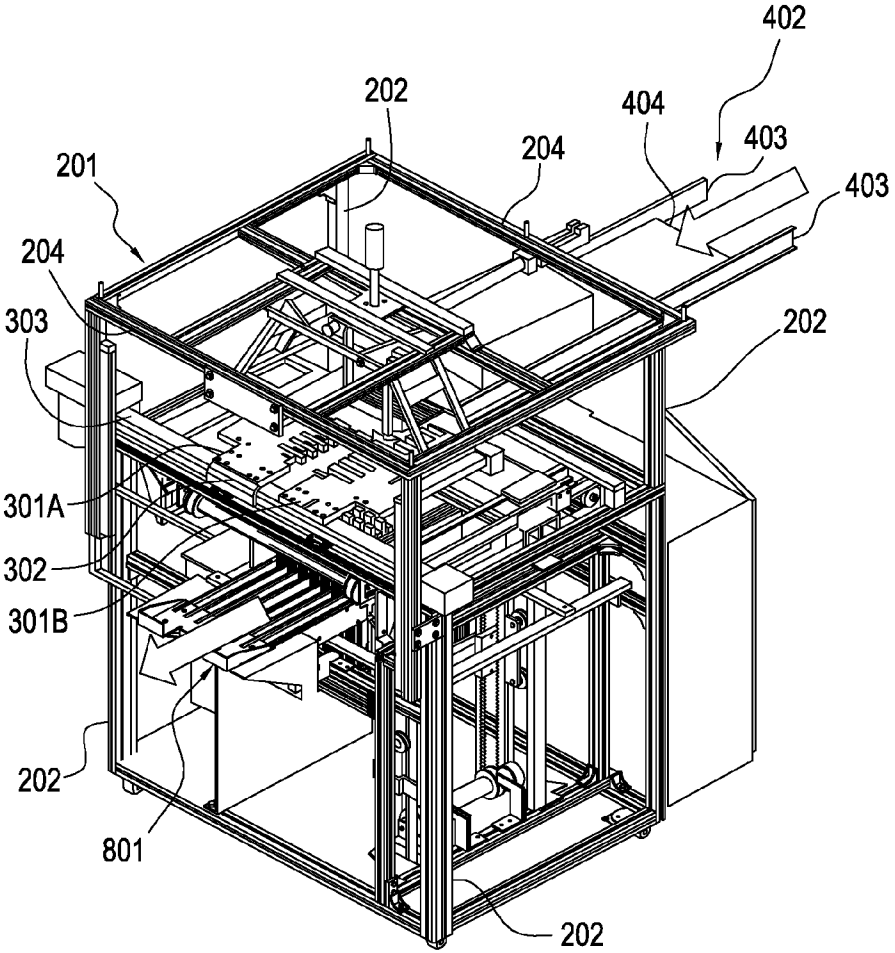
FIG. 17B is a front view of the automated debundling system of FIG. 17A.

FIGS. 17A-17C show a debundling system 100' according to another embodiment of the disclosed subject matter. The system 100' includes a supporting structure 201 including four substantially vertical supporting beams 202 supporting a first set of substantially horizontal supporting arms 203 and second set of substantially horizontal supporting arms 204, the second set being positioned vertically higher on the supporting beams 202 than the first set of supporting arms 203. The supporting arms 204 are substantially parallel to each other and are attached (mounted, connected, secured) at respective ends to the vertical beams 202. The supporting arms 203 are also substantially parallel to each other, and are also attached (connected, secured) at respective ends to the vertical beams 202 above the first set of supporting arms 203. Two supporting plates 301A and 301B are movably mounted (attached, connected, secured) to the parallel supporting arms 203 at respective opposing ends so that each plate 301A and 301B extends between the two parallel arms 203. Each of the supporting plates 301A and 301B has a substantially flat upper surface. Together, the supporting plates 301A and 301B form a supporting surface 301 for receiving and securely holding an incoming bundle 70. The supporting plates 301A and 301B are each mounted to the supporting arms 203 so that upper surfaces of the supporting plates 301A and 301B face a bottom surface of the incoming bundle 70. The supporting plates 301A and 301B are attached to the supporting arms 203 using mounting devices such as, but not limited to, brackets 302, so that they can each be separately moved along a portion of the length of the supporting arms 203 toward and away from each other in a horizontal direction using powered actuators 303 such as pneumatic cylinders, for example. The actuators 303 are operably connected to a controlling system and provide controlled movement of the supporting plates 301A and 301B along the horizontal axis. The supporting plates 301A and 301B can be separately and individually moved toward and away from each other along the horizontal axis. Alternatively, the supporting plates 301A and 301B can be moved together using one actuator. During the movement of the plates 301A and 301B toward and away from each other, a side surface of the first supporting plate 301A faces a side surface of the second supporting plate 301B.

Figure 25:
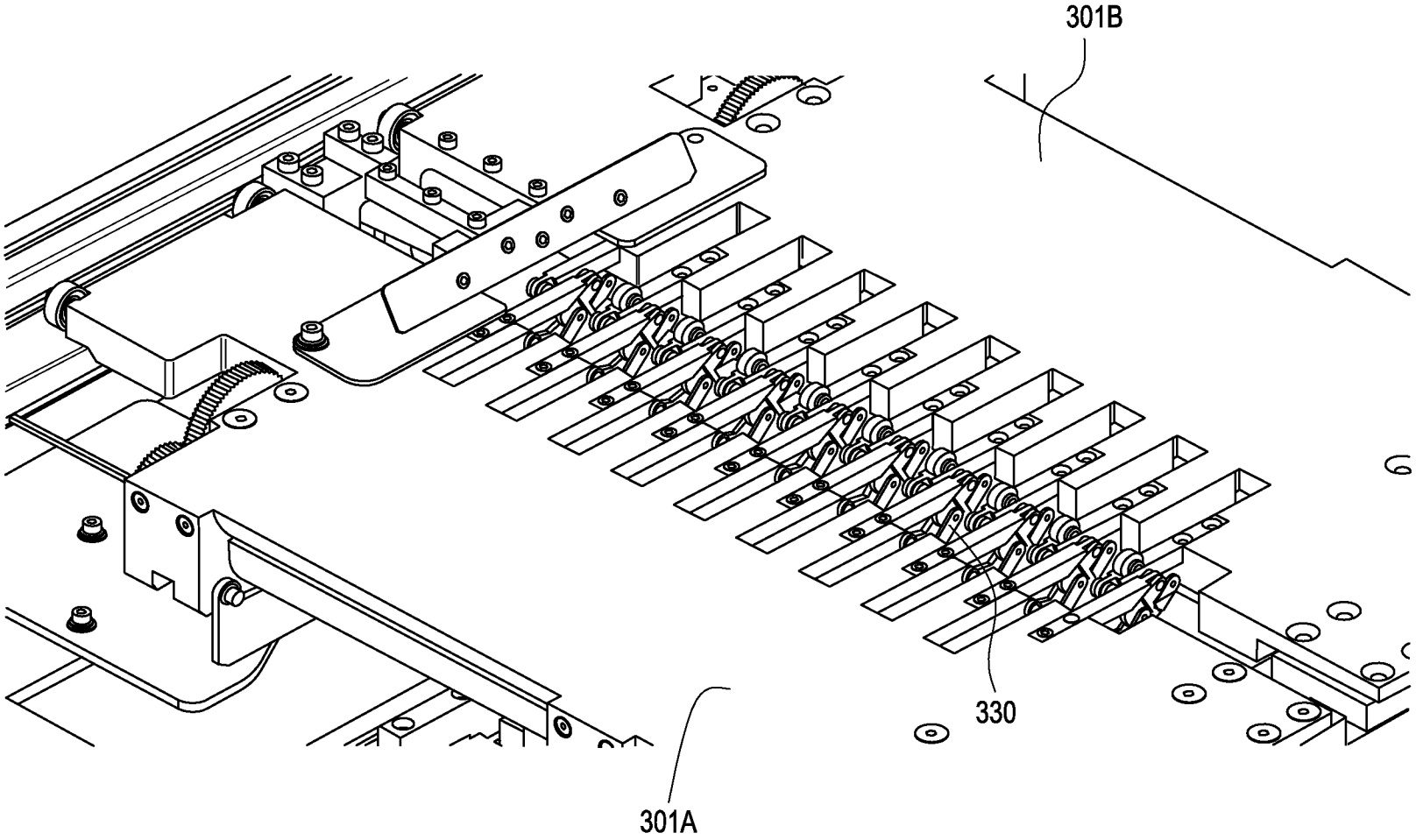
FIG. 25 is a top view of a supporting device of a debundling system according to an embodiment.
Figure 26:
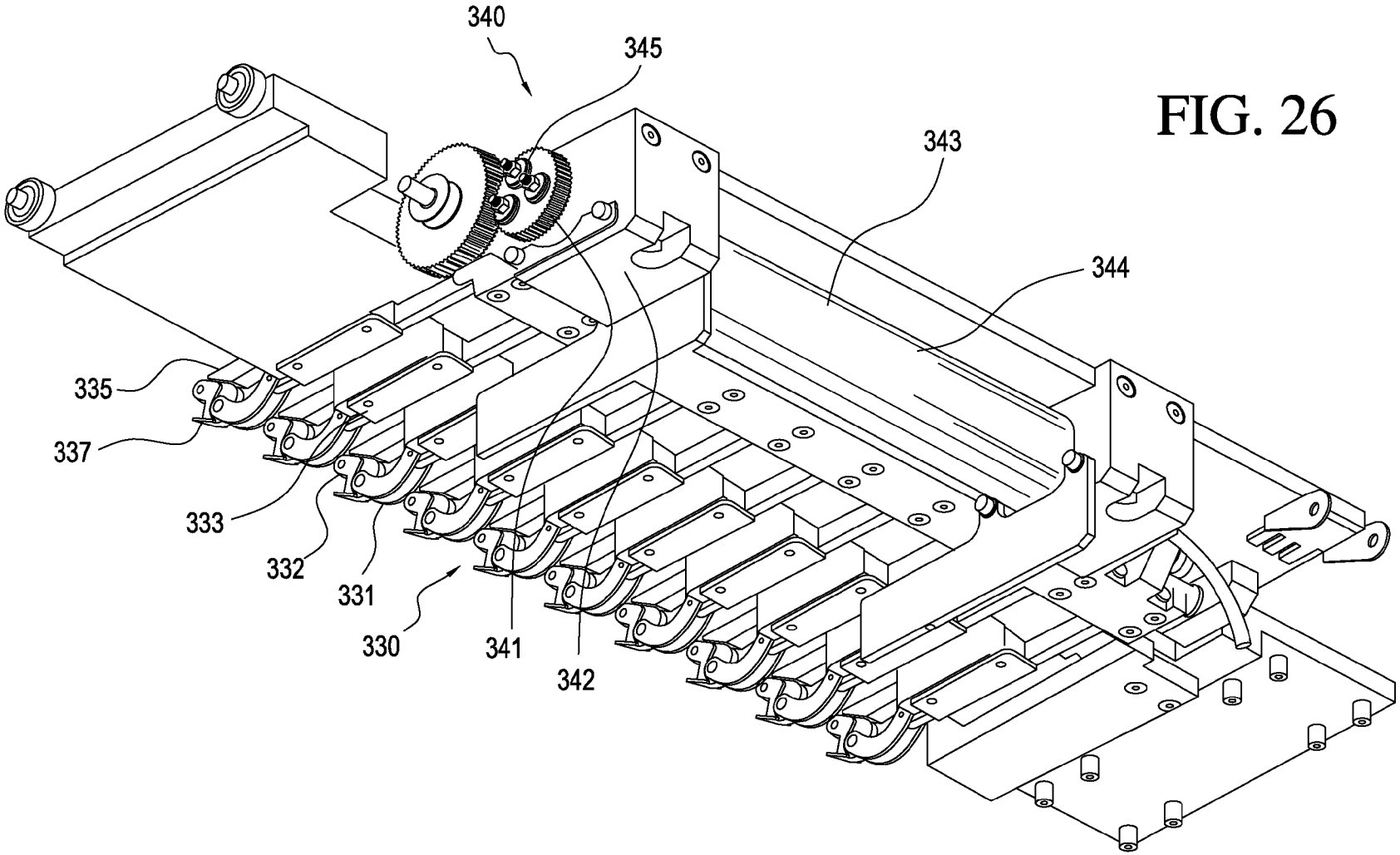
FIG. 26 is a bottom view of a portion of the supporting device of FIG. 25 showing a plurality of gripping devices.
Figure 27:
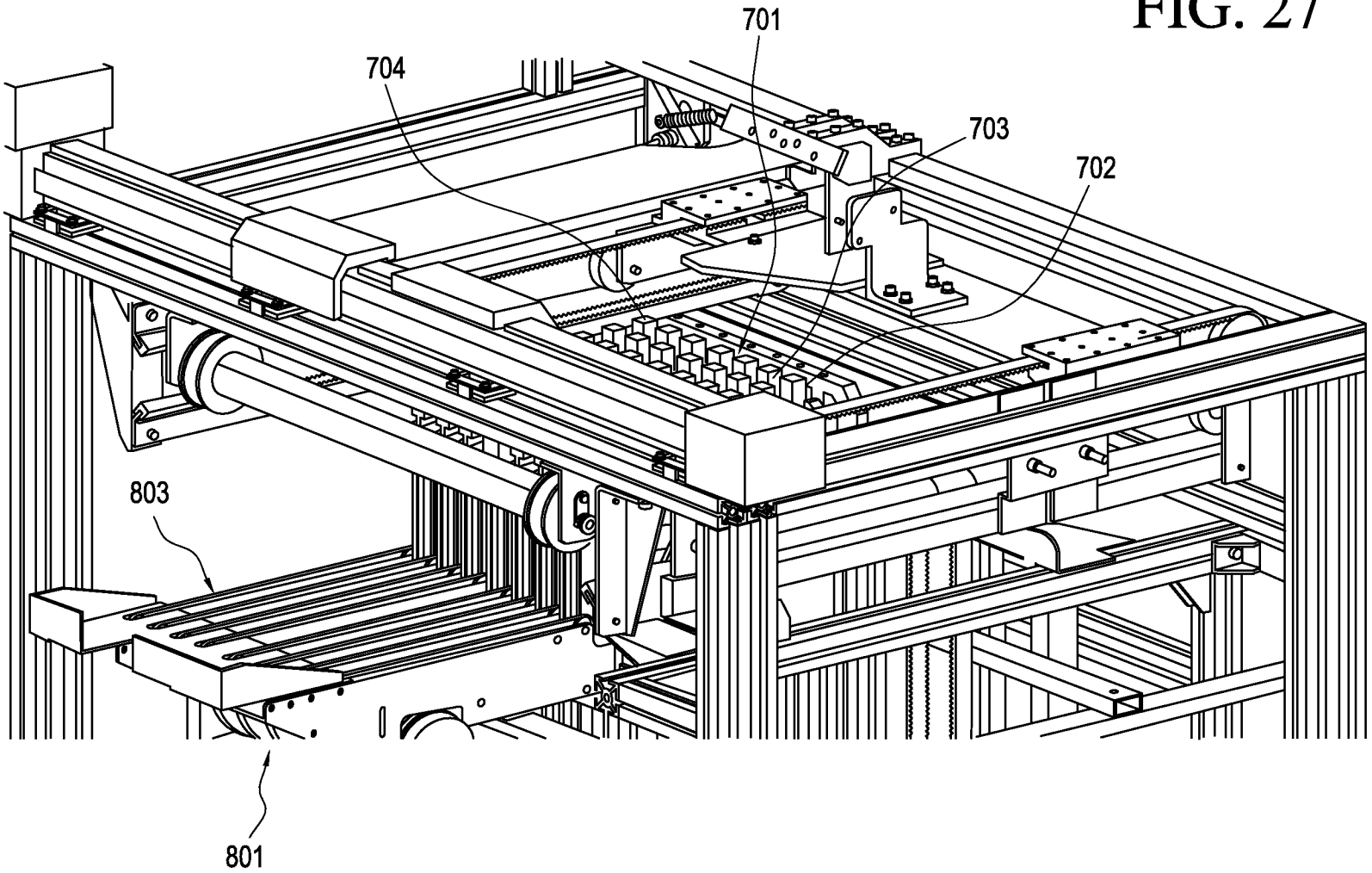
FIG. 27 is a side perspective view of a debundling system without the supporting plates showing a lifting mechanism.

Each of the supporting plates 30A and 301B has a plurality of gripping devices 330 mounted so that the gripping devices 330 are positioned lengthwise along respective facing side surfaces of the supporting plates 301A and 301B, as shown in detail in FIGS. 25 and 26. The gripping devices 330 are aligned along a lengthwise direction on the respective side surfaces of the supporting plates 301A and 301B at regular intervals in such a way that the gripping devices 330 of the first supporting plate 301A are shifted (offset) relative to the gripping devices 330 of the second supporting plate 301B. The gripping devices 330 are mounted on each of the supporting plates 301A and 301B using brackets 335 (shown in FIG. 26) so that a horizontally extending curved gripping portion (hook) 332 of the gripping device 330 of the first supporting plate 301A faces a curved gripping portion (hook) 332 of the gripping device 330 of the second supporting plate 301B. The gripping devices 330 can be pivoted from a first position where claw portions 337 of the curved gripping portions 332 are below the upper surfaces of the supporting plates 301A and 301B, to a second position where the claw portions 337 are slightly above the upper surfaces of the supporting plates 301A and 301B.

FIGS. 25 and 26 show the supporting plates 301A and 301B, as well as the operation of the pivoting movement of the gripping devices 330. Each of the supporting plates 301A and 301B includes, on a bottom surface thereof, a plurality of movable levers 333 each connected at one end thereof to a moving mechanism 340. The other end of each of the levers 333 is fixedly connected to a connecting portion 331, which is then pivotably connected to the curved gripping portion 332. The moving mechanism 340 is configured to move the levers 333 toward and away from the connecting portions 331, so that when the levers 333 move toward the connecting portions 331 they exerts a force upon the connecting portions 331, and the connecting portions exert a force on the gripping portions 332. This causes the curved gripping portions 332 to rotate around corresponding pivot points 336 causing the claw portions 337 to rotate in an upward direction. The claw portions 337 can rotate through a wide range of angles, to include various claw positions, including, but not limited to, a first position where the claw portions 337 are below the supporting plates 301A and 301B, an intermediate position where the claw portions 337 are level with the supporting plates, and a second position where the claw portions 337 are above the supporting plates 301A and 301B. The reverse motion allows for the levers 333 to pull away from the connecting portions 331 and therefore pivot the claw portions 337 from the second position to the first position. The combined movements of the above described elements to pivot the claw portions 337 are designed so that the angles and positions of the claw portions 337 are controlled and so that the claw portions 337 can be moved to a position where they can grab and hold the cut wrapping 71, as well as to a release position where the gripped wrapping 71 can be released from the claw portions 337. The gripping devices 330 are designed to grab (catch) the plastic wrapping 71 but also to minimize the damage to the bundle 70 during the pivoting, grabbing, and the moving of the wrapping 71.

At least one of the supporting plates 301A, 301B can include a cutting device 43 as shown in FIG. 7 positioned on its side surface and adjacent the gripping devices 330, the cutting device 43 being configured to cut the second straps 73 on a bottom surface of the bundle 70 while the first and second supporting plates 301A and 301B are moved away from each other. These second straps 73 are straps that are positioned in a direction perpendicular to the first straps 72.

In various embodiments, each of the supporting plates 301A and 301B can include cutting devices 43 as shown in FIG. 7 so that a first cutter is positioned on the first supporting plate 301A and a second cutter is positioned on the second supporting plate 301B.

In various embodiments, each of the second cutting devices 43 includes a bracket 490 for secure mounting of the cutting device 43 on the supporting plates 301A and 301B, a curved grabbing and pinching portion 49 which is shaped so as to grab, pinch and hold straps 73 after cutting the straps 73 with a cutting blade 48 until the straps 73 can be safely manually removed from the cutting devices 43 (see FIG. 12).

In various embodiments, every other curved gripping portion 332 on each supporting plate 301A and 301B can include a blade configured to cut the straps 73.

In various embodiments, every other gripping portion 332 on each supporting plate 301A and 301B can have a shape as shown in FIG. 12, so as to be able to cut, grab, pinch and hold straps 73 after cutting the straps 73 with a cutting blade 48 until the straps 73 can be safely manually or automatically removed from the gripping portions 332.

The moving mechanism 340 can include a motorized pulley system 343 including a geared motor drive (not shown) hermetically sealed in a cylindrical shell 344, the shell 344 being operatively connected to a pulley shaft (pulley axle) 345. In a typical application of a motorized pulley, the pulley shaft or shafts are stationary and it is the cylindrical shell that rotates on the pulley shafts. This is done by having the geared motor drive transfer the torque from the engine through a gearbox into the cylindrical shell, which causes the cylindrical shell to turn, producing the desired motion. The cylindrical shell is typically constructed from steel, aluminum, or stainless steel. In the present application, however, it is the cylindrical shell 344 which is kept stationary and the pulley shaft 345 is the one that is being rotated. The cylindrical shell 344 is kept from rotating using a pulley clamp 342. The torque from the engine in this case is transferred to the pulley shaft 345 which, while it spins it exerts a force on the levers 333. The movement of levers 333 and the corresponding movement of the claw portions 337 are controlled by the rotation of the gear. Attached to the pulley shaft 345 is an external sprocket 341. Using this configuration of a motorized pulley, a simple, powerful and efficient moving mechanism 340 is obtained.

FIG. 25 shows the supporting plates 301A and 301B being moved toward each other until the gripping portions 332 of the first supporting plate 301A are intertwined with the gripping portions 332 of the second supporting plate 301B (when looking at it from the top). At their closest position, there is a slight separation between the supporting plates 301A and 301B. This slight separation between the supporting plates 301A and 301B exposes a portion of the bottom surface of the bundle 70 when the bundle 70 is loaded onto the upper surfaces of the supporting plates 301A and 301B (when looking at it from the bottom).

Figure 18:
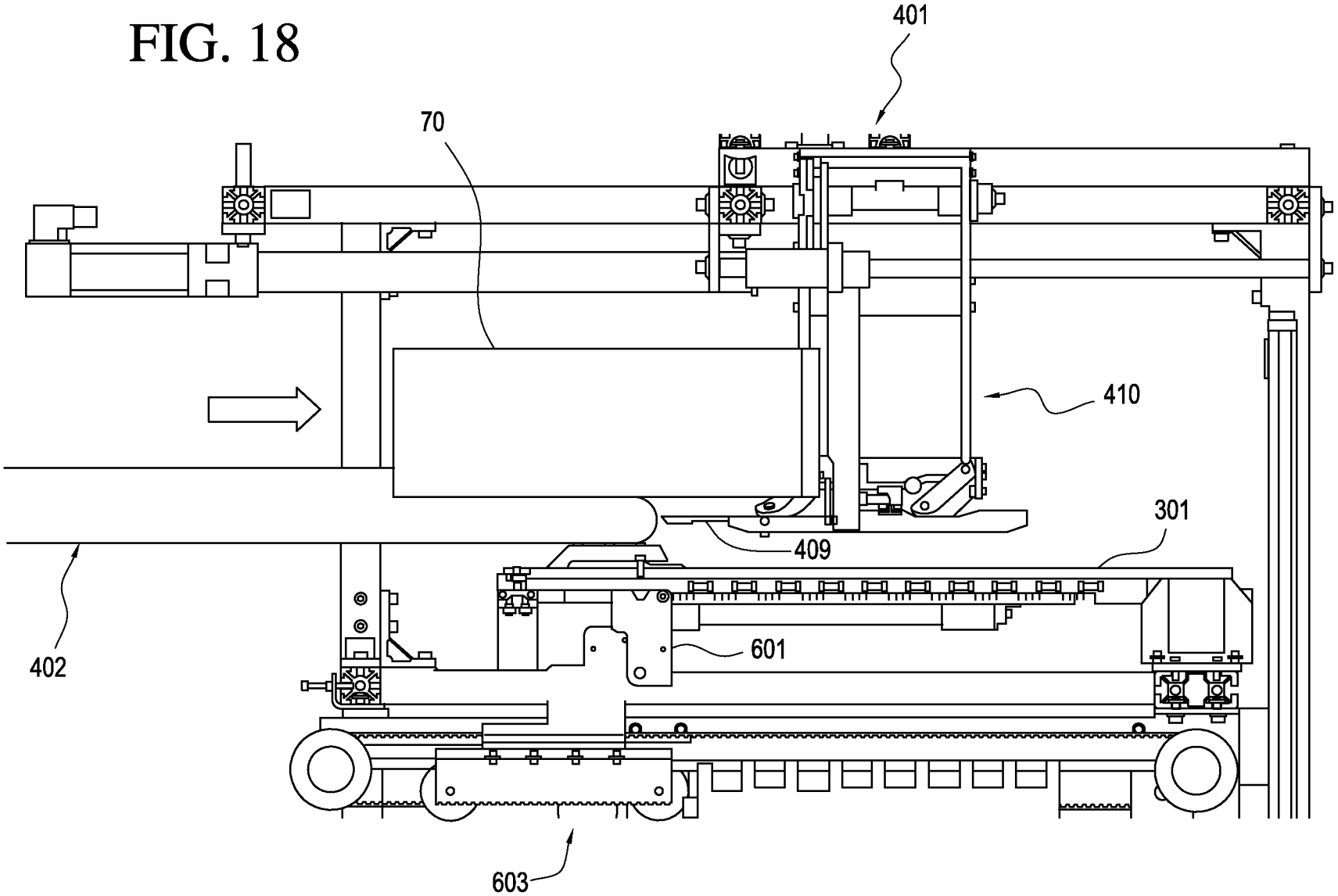
FIG. 18 illustrates a bundle entering the automated debundling system of FIGS. 17A-C.
Figure 19:
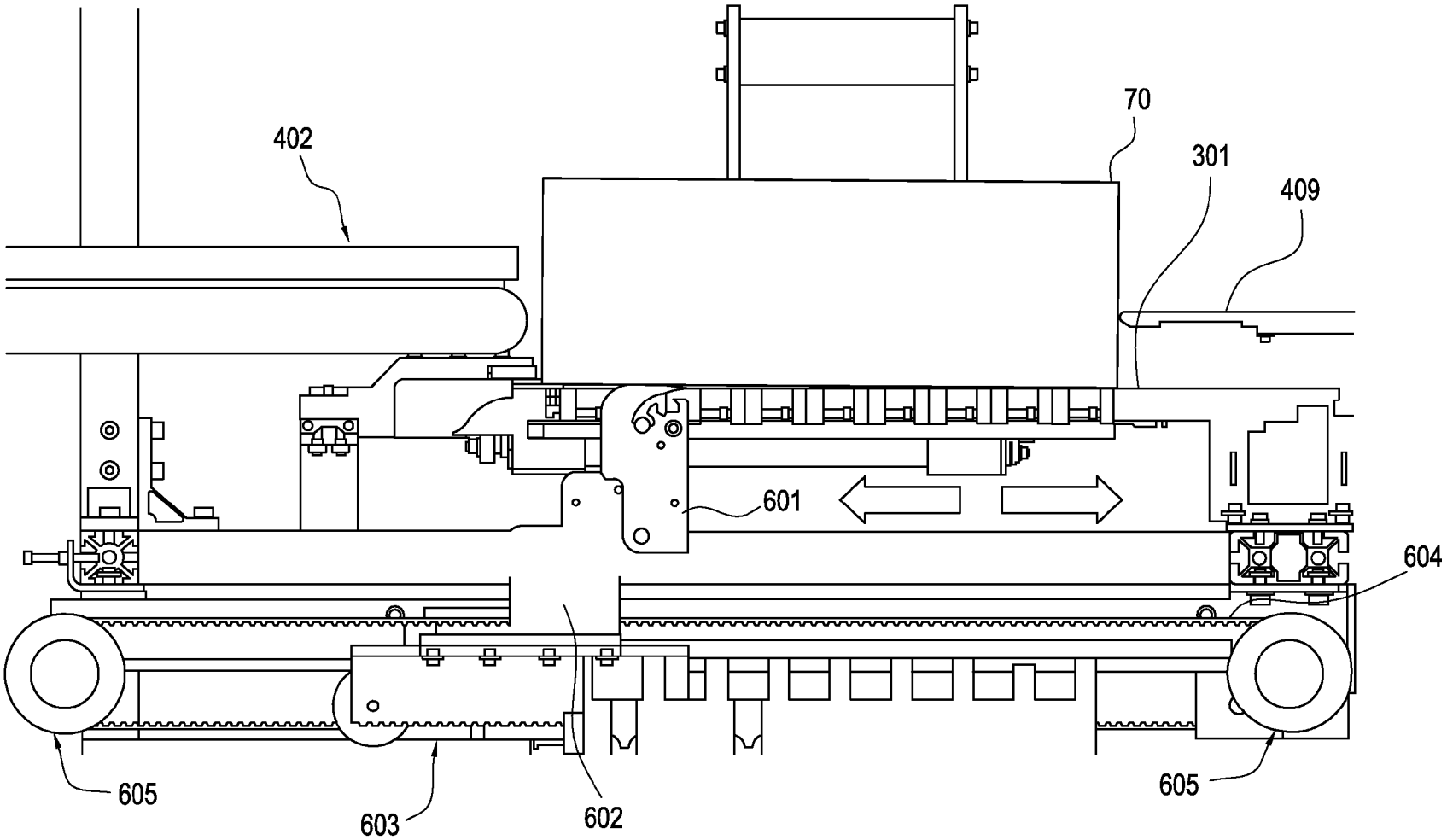
FIG. 19 illustrates a bundle positioned on a supporting plate of the automated debundling system of FIGS. 17A-C.

The incoming bundle 70, which may have a thin film polymeric wrapping 71 and/or a plurality of straps 72 and 73, can be loaded automatically onto the upper surfaces of the supporting plates 301A and 301B using an automatic loading mechanism 401. The bundle 70 can be moved to the loading mechanism 401 using a conveying device 402, which can include, but is not limited to, a belt conveyor consisting of a metal frame 403 with rollers (not shown) at either end of a flat metal bed. The belt 404 is looped around each of the rollers and when one of the rollers is powered by an electrical motor, for example, the belting 404 slides across the solid metal frame bed, moving the bundle 70 toward the loading mechanism 401. Loading mechanism 401 can include a substantially flat loading surface 409 configured to receive a forward portion of the bundle 70 when the loading surface 409 is at a first position (shown in FIG. 18). The loading surface 409 is further configured to be moved to a second position using a moving mechanism 410, such as, but not limited to an actuator, as shown in FIG. 19.

In operation, the conveying device 402 conveys the leading portion of the bundle 70 onto the loading surface 409, which is positioned at a first position. Once the leading portion of the bundle 70 is loaded onto the loading surface 409, the moving mechanism 410 is moving the loading surface 409 away from the conveying device 402 so that the trailing end of the bundle 70 leaves the conveying device 402 and drops onto the supporting plate 301. The loading surface 409 is continuously moved away from the conveying device 402. While the loading surface 409 is being moved away from the conveying device 402, the bundle 70 is continuously descending onto the supporting plates 301A and 301B until the whole bundle 70 is resting on the supporting plates 301A and 301B. When the entire bundle 70 is resting on the supporting plates 301A and 301B, the loading surface 409 no longer supports the bundle 70. At that point, the loading surface 409 has reached its second position, as shown in FIG. 19.

Figure 20:
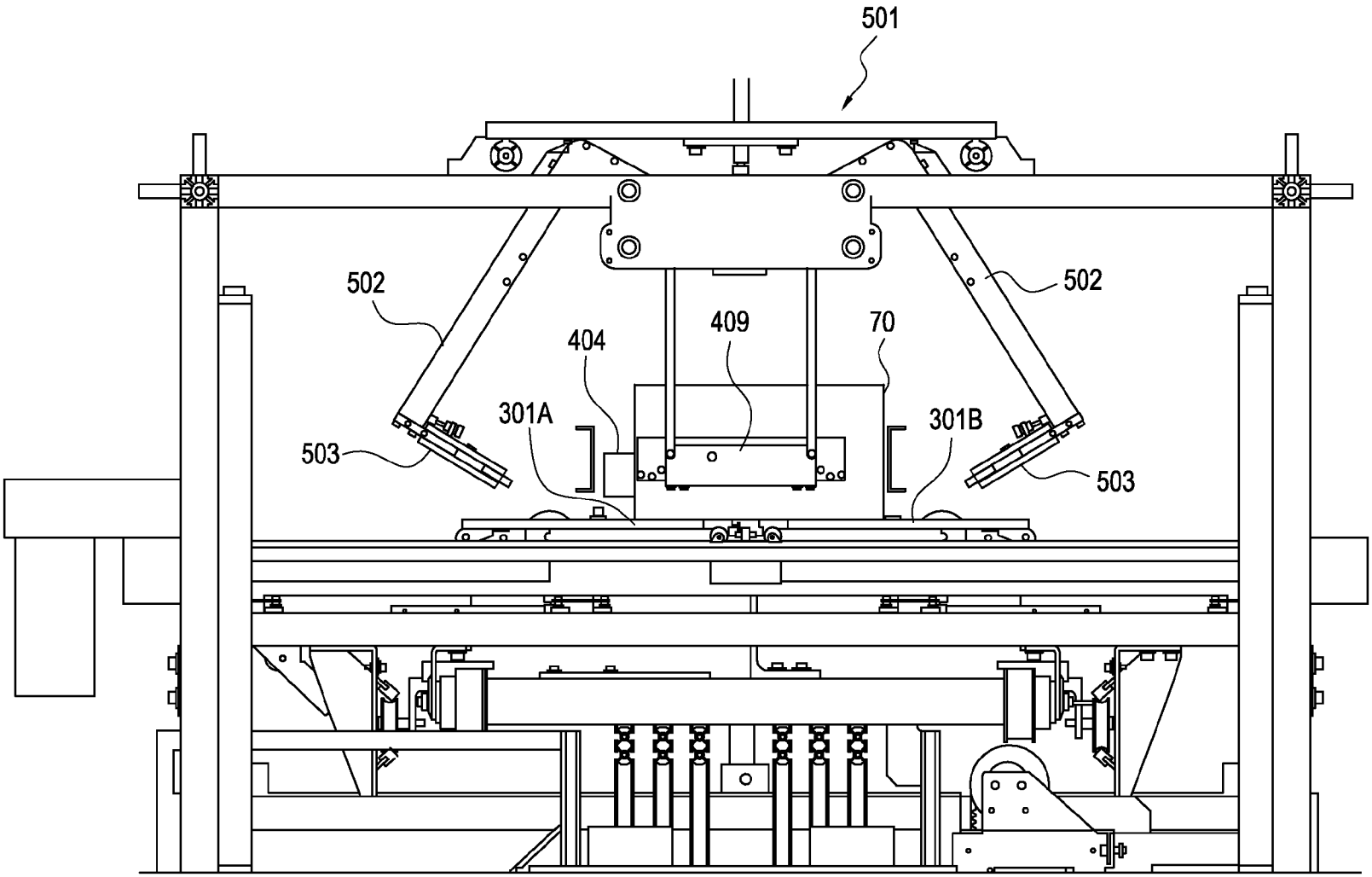
FIGS. 20-22 illustrate a centering mechanism for centering a bundle on the supporting plate of FIG. 19.
Figure 21:
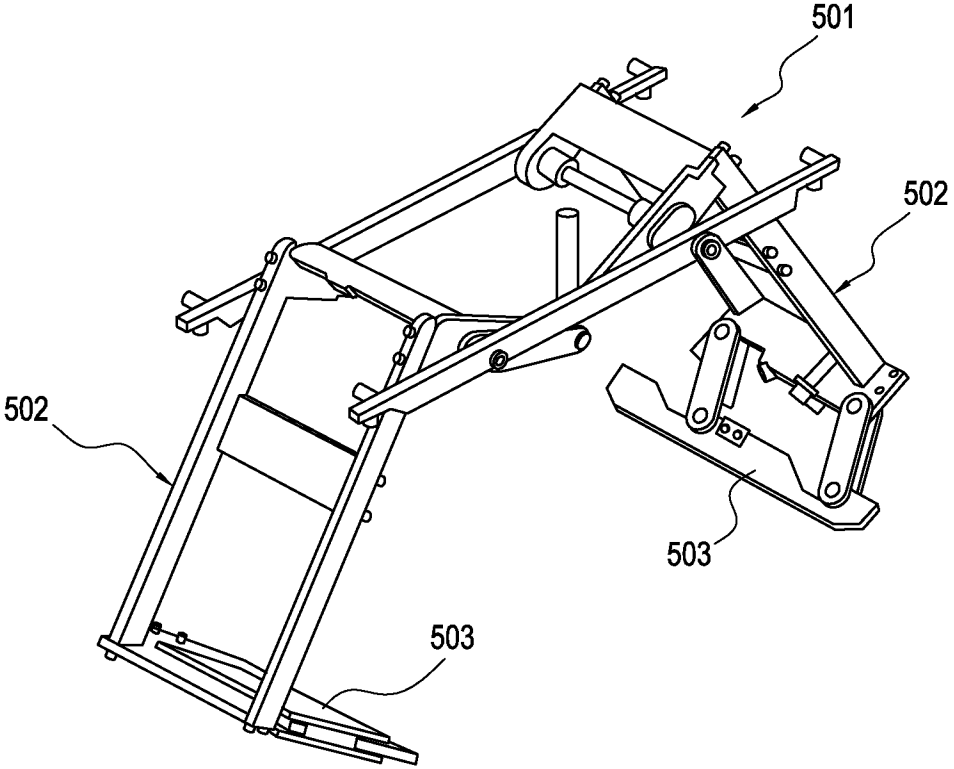
Figure 22:
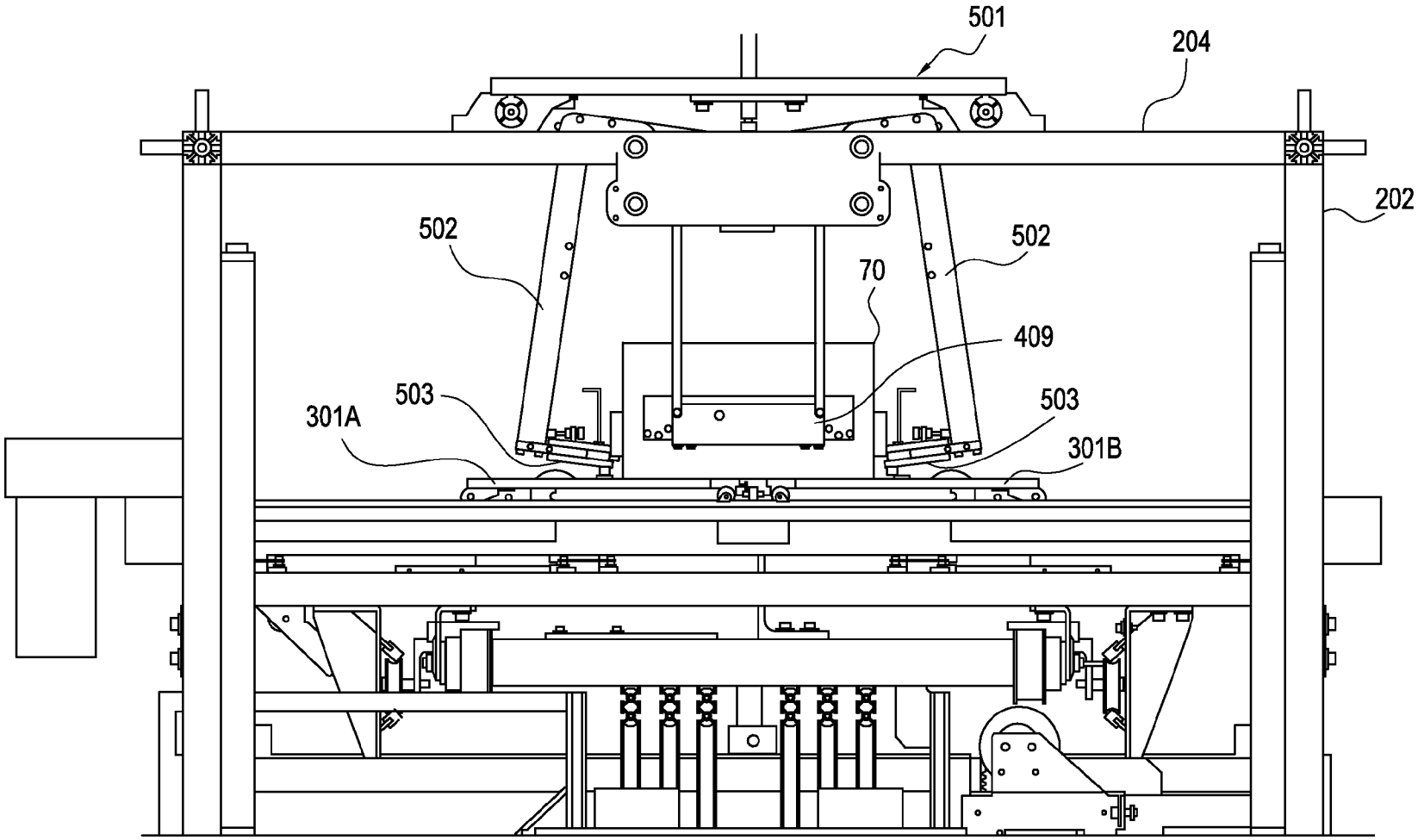
Figure 24A:
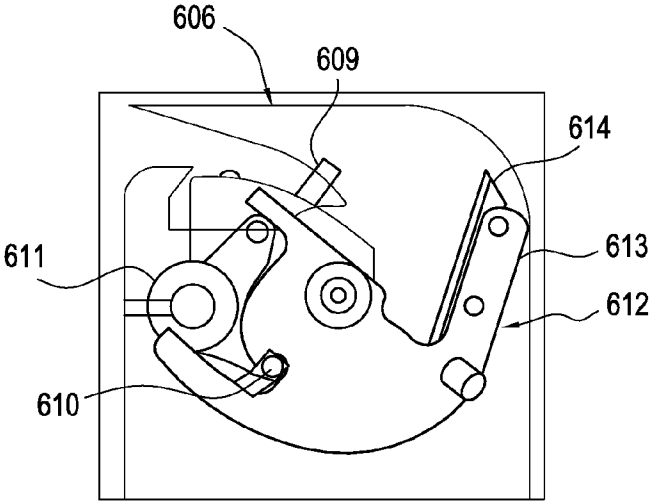
Figure 24B:
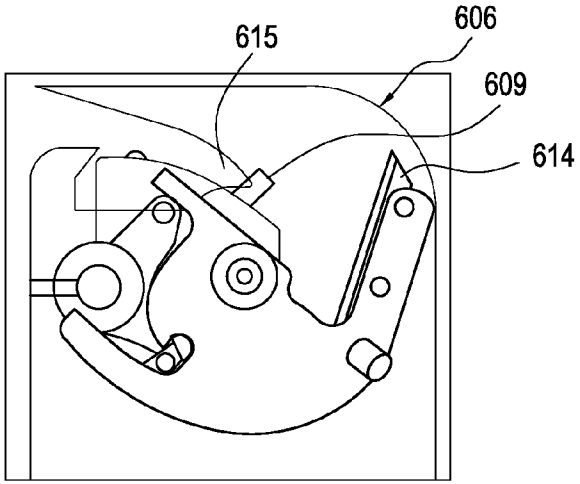
Figure 24C:
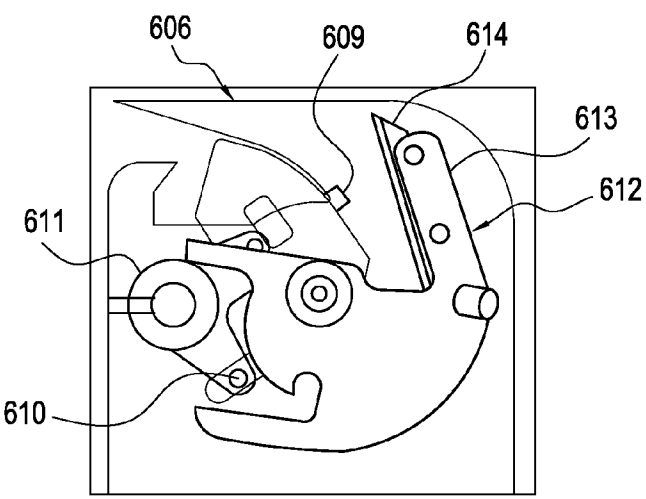
Figure 24D:
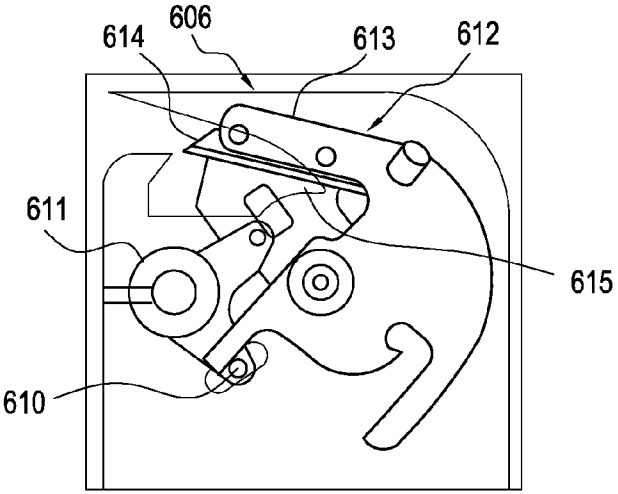

Before loading the bundle 70 onto the supporting plates 301A and 301B, the first and second supporting plates 301A and 301B are positioned close to each other leaving a gap therebetween. To ensure that the bundle 70 is positioned in a predetermined position on respective portions of each of the upper surfaces of the supporting plates 301A and 301B, and that the bundle 70 will not shift during the cutting and unwrapping process, a centering mechanism 501 is used to position and grip the bundle 70, as shown in detail in FIGS. 20-22. The centering mechanism 501 can include at least two movable arms 502 with respective arm plates 503. The arms 502 have synchronous and individual lateral mobility and are individually configured to move laterally through a wide range of positions, including a first position where the respective arm plates 503 are at a certain distance away from each other and at respective first angles with respect to a vertical axis, as shown in FIG. 20, and a predetermined second position where the arm plates 503 are at a second distance from each other, and at respective second angles with respect to the vertical axis, as shown in FIG. 22.

In operation, after the bundle 70 is positioned on the supporting plates 301A and 301B, the movable arms 502 of the centering mechanism 501 move laterally from their first positions toward respective lateral sides of the bundle 70. Each of the arms 502 is configured to move to a particular second position, which is predetermined based on the size and shape of the bundle 70, as well as the desired position of the bundle 70 relative to the supporting plates 301A and 301B, and/or relative to the conveying device 402. So, for example, if after being loaded onto the supporting plates 301A and 301B, the bundle 70 is not centered relative to the supporting plates 301A and 301B, one of the arms plates 503 in its movement toward the bundle 70 touches the lateral side of the bundle 70 and moves the bundle 70 toward the arm plate 503 of the other movable arm 502, until the first arm 502 reaches its second predetermined position. The second arm 502 also moves toward the lateral side of the bundle 70 until it reaches its second predetermined position. When both arms 502 reach their respective second positions, the bundle 70 has been moved to its centered position. Alternatively, one of the arms 502 can be moved to its second position before the other arm 502 is moved, and the first arm 502 waits at that position until the other arm 502 reaches its second position. Alternatively, both arms 502 can be moved from their respective first positions to their respective second positions at the same time.

Regardless of the timing of the individual arm 502 movements, the centering mechanism 501 ensures that the bundle 70 is moved to a previously determined position, which is a position where the bundle 70 is centered relative to the supporting plates 301A and 301B and/or the conveying device 402. The centered position of the bundle 70 ensures that the bundle 70 is positioned on each of the supporting plates 301A and 301B so as to have a first predetermined portion of the bundle 70 rest on a portion of the first supporting plate 301A and a second predetermined portion of the bundle 70 rest on the second supporting plate 301B.

In another embodiment, the centering mechanism 501 can also be configured to securely grip the bundle 70 so as to ensure that the bundle 70, once centered, will not shift until the wrapping and at least one set of straps are removed from the bundle 70. The centering mechanism 501 is attached (connected, secured, fastened) to at least one of the supporting arms 204 of the supporting structure 201 using any appropriate fastening devices/members.

The system 100' also includes a cutting mechanism 601 (shown in detail in FIGS. 23 and 24) positioned so as to be movable between the parallel supporting arms 203 underneath the supporting plates 301A and 301B. The cutting mechanism 601 is securely fastened to a carrier 602. The carrier 602 is securely attached to a moving mechanism 603, which pushes and retracts the carrier 602 so that the carrier 602 slides the cutting mechanism 601 underneath the supporting plates 301A and 301B in a direction as shown by the arrows in FIG. 19. The cutting mechanism 601 is moved in a direction which is perpendicular to the direction of movement of the supporting plates 301A and 301B, and perpendicular to the supporting arms 203. The moving mechanism 603 can include, but is not limited to, a belt drive where a belt of a flexible material 604 is looped over pulleys 605. However, any other type of actuators may be used as a source of moving the cutting mechanism 601. The carrier 602 is positioned on the supporting structure 201 so as to be able to move the cutting mechanism 601 along the length of the separation between the supporting plates 301A and 301B so as to cut the wrapping 71 and the first set of straps 72 along the exposed bottom surface of the bundle 70 when the bundle 70 is fixedly positioned on the supporting plates 301A and 301B. The moving mechanism 603 is configured to move the cutting mechanism 601 in a first instance along the separation between the supporting plates 301A and 301B until the cutting mechanism 601 reaches a position which is opposite its starting position, and to retract the cutting mechanism 601 along the same path in a second instance. The cutting mechanism 601 can be shaped so that it cuts the wrapping 71 and straps 72 during the first instance.

Figure 23:
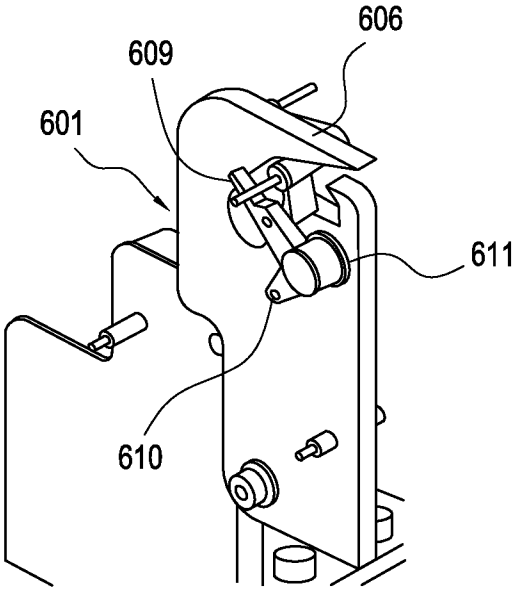
FIGS. 23-24D illustrate a cutting device according to an embodiment.

FIGS. 23 and 24 illustrate the main components of the cutting mechanism 601, as well as the sequence of the wrap and strap cutting operation. The cutting mechanism 601 includes a clamping portion 606 with a cutting edge 607, which is sharp enough to be able to cut the wrapping 71 of the bundle while being moved between the separation of the supporting plates 301A and 301B in the first instance. Attached to the clamping portion 606 is a mechanical trigger arrangement 608 configured to force a relative rotary movement of a cutting device 610 relative to the clamping portion 606, as shown in detail in FIGS. 24 A-D. The cutting device 612 operatively coupled to the clamping portion 606 includes a blade holding portion 613 securely holding a cutting blade 614. The mechanical trigger arrangement 608 includes a trigger 609 and a release lever 610 operatively connected to each other using a fastening mechanism 611. Before the commencing of the wrap and strap cutting operation by the cutting mechanism 601, the starting position of the trigger 609 and the release lever 610 are as shown in FIG. 24A. During the cutting operation, the cutting mechanism 601 is being moved along the separation between the supporting plates 301A and 301B in the first instance so that the cutting edge 607 faces the direction of movement of the cutting mechanism 601, and cuts the wrapping 71 of the bundle 70 along its exposed bottom portion. If the bundle 70 includes one or more straps strapping the bundle 70 along a direction which is perpendicular to the movement of the cutting mechanism 601, while the wrapping is being cut by the cutting edge 607, the strap will push the trigger 609, which will then move the release lever 610, as shown in FIG. 24B. The movement of the release lever 610 engages the cutting device 612, so that while the clamping portion 606 traps the strap in its clamping nook 615, the cutting blade 614 rotates toward the trapped strap (FIG. 24C). When the cutting blade 614 reaches its predetermined rotational position, as shown in FIG. 24D, it cuts the trapped strap 72. Once the tension exerted on the trigger 609 by the strap is released, the cutting device 612 will be rotated back to its starting position, after which the arrangement is ready for the repetition of a new wrap and strap cutting sequence. The cutting mechanism 601 can be further configured to pinch, hold and carry the cut straps 72 back to its starting position. The cut straps 72 can be manually or automatically removed from the cutting mechanism 601 after the cutting operation, and disposed of in trash or recycling bins 615.

After the wrapping 71 and the first set of straps 72 are cut by the cutting mechanism 601, the supporting plates 301A and 301B are first moved toward each other and then moved away from each other along the horizontal axis. FIG. 25 illustrates the supporting plates 301A and 301B moving closer to each other. While the supporting plates 301A and 301B are moving closer to each other, their respective claw portions 337 are moved to a position in which the claw portions 337 are slightly above the upper surfaces of the supporting plates 301A and 301B so as to be able to grab the loose ends of the now cut wrapping 71, and also to allow the cutting blades in the gripping portions 332 to cut the second set of straps 73. When the supporting plates 301A and 301B are moving apart, the weight of the bundle 70 gently releases the bundle 70 from the wrapping 71, allowing the gripping devices 330 with their respective claw portions 337 to grip respective edges of the now cut and loosened wrapping 71 on the bottom of the bundle 70. As the supporting plates 301A and 301B move further apart, the gripping devices 330 cut the second straps 73 and grab and carry the wrapping 71 and the cut straps 73 further away from the bottom of the bundle 70.

Figure 28:
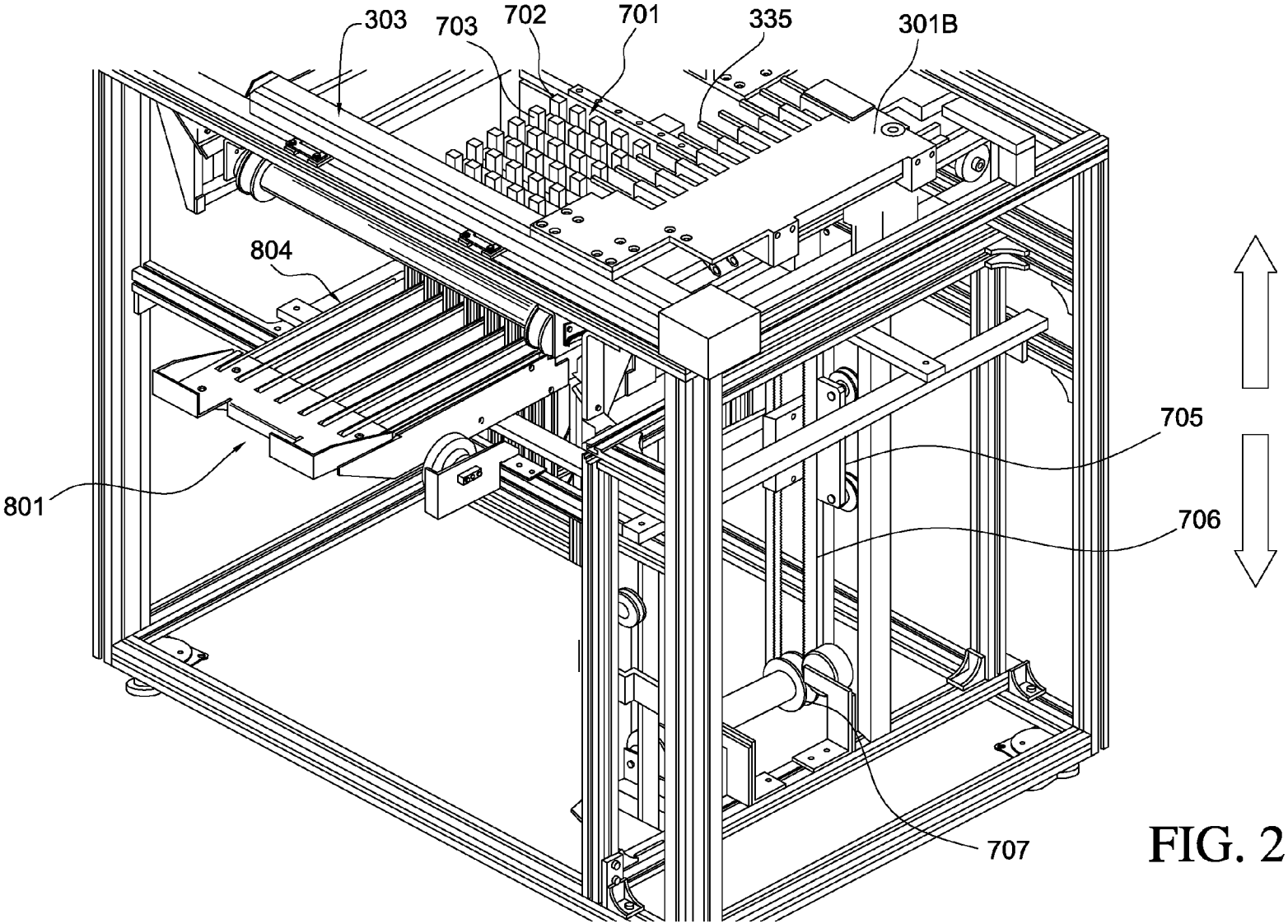
FIG. 28 is a side perspective view of a debundling system with a lifting mechanism.

At the same time that the supporting plates 301A and 301B are moving away from each other, a lifting mechanism 701 comprising a plurality of supporting columns 702 arranged in an array, the upper surfaces 704 of which form together a supporting surface 704A, is moving vertically upward, as shown by the arrow pointing up in FIG. 28, such that, when the supporting plates 301A and 301B are far enough from each other so that the gap between the supporting plates 301A and 301B is big enough that the bundle 70 could fall through, the supporting surface 704A arrives at a position which is just below the bundle 70 to receive the now loose bundle 70. This allows the bundle 70 to gently drop onto the supporting surface 704A while still maintaining the integrity of the loose bundle 70. To move the lifting mechanism 701 up and down along the vertical axis as shown by the up and down arrows in FIG. 28, an actuator may be used, including, but not limited to, motorized belt drives or roped hydraulics including a belt 706 and two or more pulleys 707 to raise and lower the lifting mechanism 701.

After the bundle 70 is received on the supporting surface 704A, the lifting mechanism 701 is starting to move vertically downward, as shown by the down arrow in FIG. 28, until the supporting surface 704A is level with a conveying mechanism 801. As the bundle 70 is being moved downward by the lifting mechanism 701, the wrapping 71 is completely separated from the bundle 70 and it is gripped on one end by the gripping devices 330 of the first supporting plate 301A and at the other end by the gripping devices 330 of the second supporting plate 301B. The gripping portions 332 which include cutting blades also carry the straps 73 away from the bundle 70. While the bundle 70 is moving downward and away from the supporting plates 301A and 301B, the claw portions 337 of the gripping devices 330 of one of the supporting plates (301A or 301B) are pivoted to a release position where the claw portions 337 release the wrapping 71, and the wrapping 71 is held only by the claw portions 337 of the other supporting plate. The wrapping 71 can then be either manually or automatically removed from the claw portions 337 still holding the wrapping 71, or the claw portions 337 can be pivoted to a release position where they can automatically release the wrapping 71. The wrapping 71 as well as the straps 73 can be released into a recycling or trash bin 615.

Figure 29:
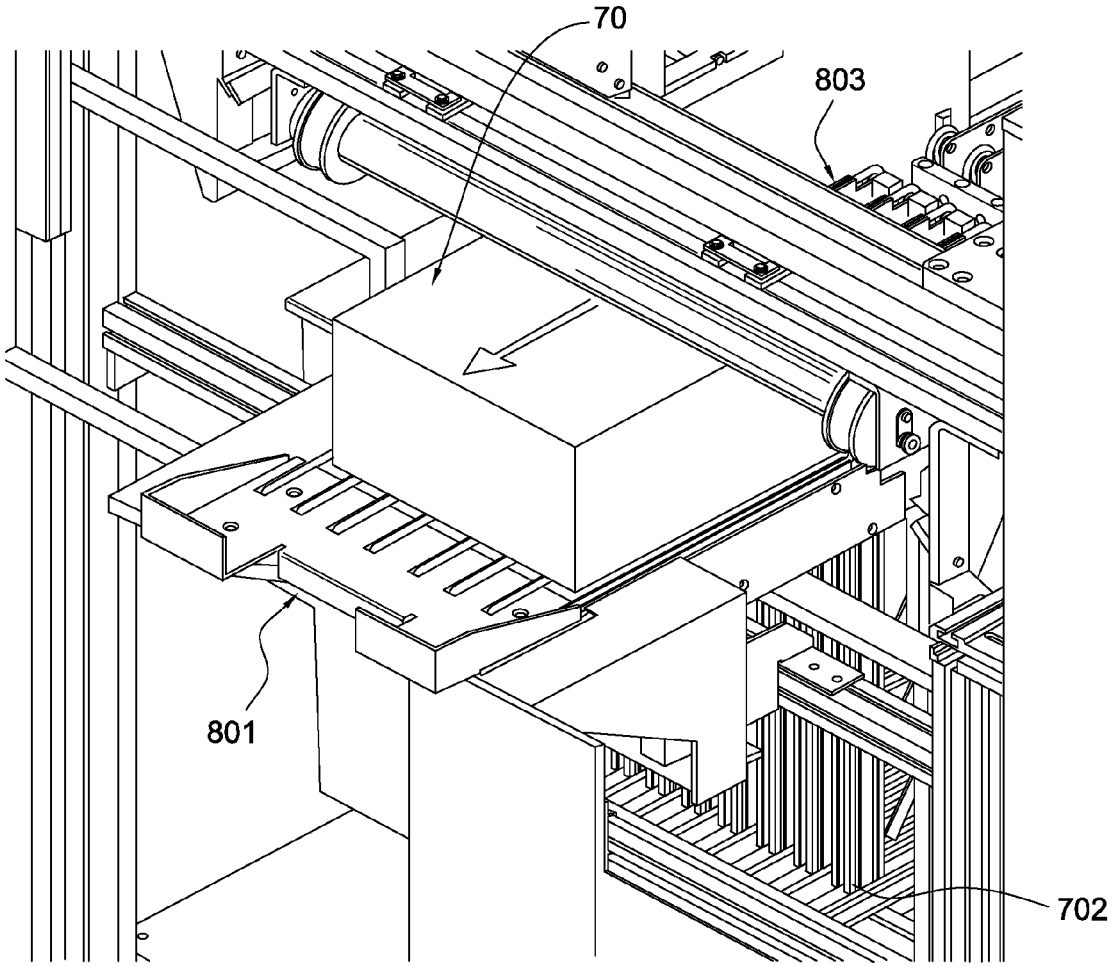
FIG. 29 shows a bundle on a conveying device.
Figure 30:
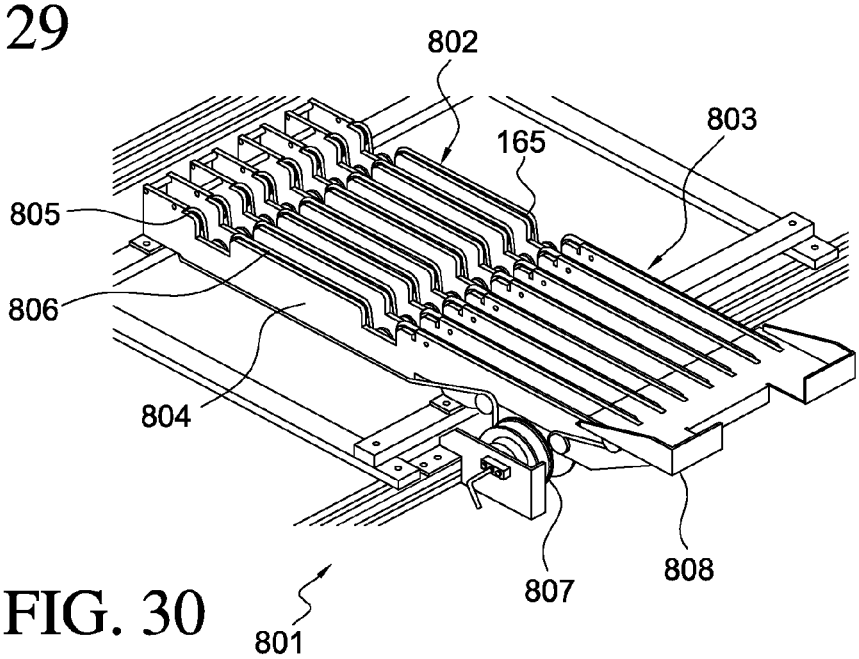
FIG. 30 is a conveying device included in a debundling system according to an embodiment.

The lifting mechanism 701 lowers the now straps and wrap free (i.e., loose) bundle 70 until the supporting surface 704A is level with a conveying mechanism 801, which can receive the loose bundle 70 and transfer it to another conveying mechanism (not shown) or to an external station for further processing. In order to convey the loose bundle 70 to the conveying mechanism 801 without disturbing the integrity of the loose bundle 70, the conveying mechanism 801 is configured to allow the supporting columns 702 of the lifting mechanism 701 to intertwine (mesh, interleave) with a portion 802 of the conveying mechanism 801, as shown in FIGS. 28-30, so that when the lifting mechanism 701 is in the position where the supporting surface 704A is level with the conveying mechanism 801, a portion of each of a plurality of longitudinal conveying channels 804 of the conveying mechanism 801 fit in between corresponding spaces 703 of the plurality of supporting columns 702. This allows the loose bundle 70 to be seamlessly transferred from the lifting mechanism 701 onto the conveying mechanism 801 without having to lift, move, or shift the loose bundle 70. The loose bundle 70 is then transported to a second portion 803 of the conveying mechanism 801 by the plurality of conveying channels 804. The conveying mechanism 801 is shown in FIG. 30 and includes the plurality of longitudinal channels 804 separated from each other by a distance suitable to accept the respective supporting columns 702. Each of the channels 804 includes a conveying belt 806 and a pulley 805 to move the belt 806, with one pulley 807 common to all conveying channels 804. The conveying mechanism 801 may also include a stopping portion 808 that stops the loose bundle 70 from falling off the conveying mechanism 801. This stopping portion 808 is optional and can be removed when the conveying mechanism 801 further conveys the loose bundle 70 to another conveying mechanism (not shown) which is external to the system 100'.

The controlled timing of the automated debundling operation is as follows. A bundle 70 including wrapping 71, a first set of straps 72, and/or a second set of straps 73, is conveyed to a debundling system 100' using conveying device 402. The conveying device 402 transports the bundle 70 in a direction as shown by the arrow in FIGS. 17A-17C onto the loading surface 409 of a loading mechanism 410 so that a leading edge of the bundle 70 rests on the loading surface 409. Once the leading edge of the bundle 70 is loaded onto the loading surface 409, the moving mechanism 410 moves the loading surface 409 away from the conveying device 402 so that the trailing end of the bundle 70 leaves the conveying device 402 and drops onto the supporting plates 301A and 301B. The loading surface 409 is moved further away from the conveying device 402. While the loading surface 409 is being moved away, portions of the bundle 70 are continuously descending onto the supporting plates 301A and 301B until the whole bundle 70 rests on the supporting plates 301A and 301B. Before loading the bundle 70 onto the supporting plates 301A and 301B, the first and second supporting plates 301A and 301B are moved close to each so as to leave a slight gap between them to expose a portion of the bottom surface of the bundle 70 when the bundle is resting on the supporting plates. Each supporting plate has its respective gripping devices 330 pivoted in a position where the claw portions 337 are below the upper surface of the supporting plates.

Next, the movable arms 502 of the centering mechanism 501 move toward the side surfaces of the bundle 70 to center the bundle 70 relative to the supporting plates 301A and 301B.

The sliding of the cutting mechanism 601 along the exposed bottom surface of the bundle 70 is next. The cutting blade 614 cuts the wrapping 71 and the first straps 72 of the bundle 70 along the exposed bottom surface of the bundle 70 without damaging the items contained in the bundle 70.

Next, the claw portions 337 of each supporting plate 301A and 301B are pivoted to a position where they are slightly above the upper surfaces of the supporting plates 301A and 301B to be able to grab the end portions of the cut wrapping 71. The supporting plates 301A and 301B are then moved away from each other to increase the gap between them.

While the supporting plates 301A and 301B are moving apart, the second cutters 43, or the gripping portions 332 including the blades, cut and pinch the second set of straps 73, and the gripping devices 330 grab respective ends of the cut wrapping 71.

While the supporting plates 301A, 301B are moving apart, the lifting mechanism 701 is moving vertically upward toward the bottom surface of the bundle 70 to receive on its upper supporting surface 704A the loose bundle 70. The movement of the lifting mechanism 701 is timed so that the upper surface 704A of the lifting mechanism 701 arrives underneath the bundle 70 right when the bundle 70 is about to fall in the gap generated by the moving supporting plates. This ensures that the bundle 70 is seamlessly transferred onto the supporting surface 704A. Once the bundle 70 is on the supporting surface 704A, the lifting mechanism 70 starts to descend (move vertically downward) until the conveying channels 804 of the conveying mechanism 801 touch the bottom surface of the loose bundle 70 and take over the transporting of the loose bundle 70 in a direction as shown by the arrow in FIGS. 17A-17C and FIG. 29.

While the bundle 70 is being transported by the lifting mechanism 701, the gripping devices 330 of one of the supporting plates (301A, 301B) pivots its claw portions 337 to a release position in order to release the wrapping 71. The gripping devices 330 of the second supporting plate (301B, 301A) maintain their first position to hold onto the wrapping 71. The wrapping 71 can then be disposed of by pivoting the gripping devices 330 of the second supporting plate into the release position to release the wrapping 71 into a trash or recycling bin 615. The items in the loose bundle 70 which are now on the conveying mechanism 801 can be manually removed by an operator for further sorting, or can be automatically transferred to another conveying mechanism for further processing. The plastic straps 72 and 73 can also be manually or automatically removed from the first and second cutting devices and recycled.

The system 100' can further include shields 901, such as light curtains, for example, to protect an operator from accidentally entering and touching an element inside a safety zone of the system, the safety zone including an area where the cutters are cutting the straps and wrapping. The system 100' can also include sensors and detectors to detect a movement of the operator around the safety zone and to automatically shut off the entire system or just a portion of the cutting and/or de-wrapping operation if presence of an operator is detected in the safety zone.

The debundling systems 100 and 100' can also include a computer processing system to automate the debundling devices and methods as described above.

In various embodiments, a computer-readable storage medium upon which is embodied a sequence of programmed instructions for removing wrapping and straps from a bundle of items wrapped with a flexible wrapping, such as, but not limited to a plastic film, and strapped with one or more straps in an automatic debundling system is disclosed, including a computer processing system which executes the sequence of programmed instructions embodied on the computer-readable storage medium to cause the computer processing system to perform the steps of:

loading the bundle onto a debundling system;

sliding a first cutting device along an exposed bottom surface of the bundle so that a cutting blade of the first cutting device cuts the wrapping and first straps along a cutting direction;

moving first and second supporting plates on which the bundle is resting away from each other along a horizontal axis to increase a separation between the supporting plates until the bundle falls through the separation onto a holding device positioned underneath the falling bundle, wherein, while the supporting plates with respective gripping devices attached to facing side surfaces of the supporting plates are moving away from each other, the gripping devices grab and pull edges of the cut wrapping, while the bundle is falling through the separation between the supporting plates, the gripping device of the first supporting plate releases the wrapping so that the wrapping is only supported by the gripping device of the second supporting plate, and the gripping device of the second plate releases the wrapping.

In various embodiments, the computer processing system further performs the steps of: centering the incoming bundle on the supporting device before the cutting and unwrapping steps; and receiving the falling bundle on a lifting mechanism which moves the bundle in a vertically downward direction to a conveying device which transports the bundle away from the system.

It is therefore, apparent that there is provided, in accordance with the present disclosure, a system, apparatus and method for automatically remove a wrapping film as well as one or more straps from a bundle.

It is therefore, apparent that there is provided, in accordance with the present disclosure, systems, devices, methods and computer program products for automatic bundle positioning, wrapper and strap cutting, wrapper removal, wrapper and strap takeaway, and debundled stack positioning and delivery for subsequent item sorting and processing, wherein the bundle moves through the different stages of its debundling operation in a continually downward moving direction.

Further, it is apparent that there is provided, in accordance with the present disclosure, systems, devices, methods and computer program products for automatic bundle positioning, wrap and strap cutting, wrap removal, wrap and strap takeaway, and debundled stack positioning and delivery for subsequent item sorting and processing, wherein the wrap and strap cutting operation is performed on a bottom surface of the bundle.

It is also apparent that there is provided, in accordance with the present disclosure, an automatic debundling system comprising a debundling station which may interface with an existing mail sorter (AFSM or FSS). The debundling station may communicate with an input conveyor of the mail sorting system to receive the bundled packages to be unwrapped. The debundling station may also communicate downstream with one or more sorting stations for further processing of the debundled items before subsequent automatic address sorting.

It is also apparent that there is provided, in accordance with the present disclosure, automatic debundling systems that can be free-standing systems used to debundle bundles including one or more preaddressed flat items, such as, mails, magazines, catalogs, brochures, and flyers.

Many alternatives, modifications, and variations are enabled by the present disclosure. Features of the disclosed embodiments can be combined, rearranged, omitted, etc. within the scope of the invention to produce additional embodiments.

Furthermore, certain features of the disclosed embodiments may sometimes be used to advantage without a corresponding use of other features. Accordingly, Applicant intends to embrace all such alternatives, modifications, equivalents, and variations that are within the spirit and scope of the present disclosure.

While embodiments and applications of this invention have been shown and described, it would be apparent to those skilled in the art that many more modifications are possible without departing from the inventive concepts herein. The invention is not limited to the description of the embodiments contained herein, but rather is defined by the claims appended hereto and their equivalents.

What is claimed is:

1. A system for removing wrapping and straps from a bundle of items, the system comprising:

a loading module for loading an incoming bundle onto a debundling module, the debundling module including:

a supporting member being configured to support the incoming bundle and to expose a portion of a bottom surface of the bundle;

a cutting member for making cuts in the wrapping and a first strap along the exposed bottom surface of the bundle; and a gripping member positioned on the supporting member for cutting a second strap on the bottom of the bundle, and gripping and removing the cut wrapping from the bundle; and a holding module for receiving the bundle from the debundling module and transferring the bundle to a conveying module for further processing, wherein the bundle is moving in a downward direction when transferred from one module to another.

2. A system for removing wrapping and straps from a bundle of items, the system comprising:

a supporting device configured to support an incoming, bundle, the supporting device including a first supporting plate and a second supporting plate, the first supporting plate positioned adjacent the second supporting plate along a horizontal axis such that the incoming bundle is supported on a portion of a top surface of the first supporting plate and a portion of a top surface of the second supporting plate, the top surface of the first supporting plate including a side surface and the top surface of the second supporting plate including a side surface facing the top surface of the first supporting plate, the first and second supporting plates each including at least one gripping device positioned on the respective facing side surfaces, the gripping device on the side surface of the first supporting plate being offset from the gripping device on the facing side surface of the second supporting plate;

a moving device configured to move the first and second supporting plates toward and away from each other along the horizontal axis;

a first cutting device positioned adjacent the supporting device and movable in a direction perpendicular to the direction of movement of the supporting plates so as to make cuts in the wrapping and first straps on a bottom surface of the bundle while the bundle is positioned on the first and second supporting plates; and a holding device configured to receive the bundle after the wrapping and the first straps have been removed from the bundle, wherein, while the bundle is positioned on the portions of the top surfaces of the first and second supporting plates, the first and second supporting plates are positioned at a predetermined distance from each other so as to expose a portion of the bottom surface of the bundle, the first cutting device cuts the wrapping and. the first straps on the exposed bottom portion of the bundle while moving along the separation.

after the wrapping and the first straps are cut, the moving device moves the first and the second supporting plates away from each other to increase the separation between the plates until the bundle falls through the separation onto the holding device, and the first and second gripping devices grab and pull the cut edges of the wrapping, and the gripping device of the first supporting plate releases the wrapping so that the wrapping is held by the gripping device of the second supporting plate, and the gripping device of the second plate releases the wrapping.

3. The system of claim 2, further comprising a loading device for loading the incoming bundle onto the supporting device.

4. The system of claim 2, further comprising a centering device for moving the bundle along the horizontal axis to be centered with respect to the first and second supporting plates.

5. The system of claim 2, further comprising a controlling device operatively connected to each gripping device to control a pivoting movement of each gripping device, the pivoting movement, including a position where the gripping devices grab the wrapping and a position in which the gripping devices release the wrapping.

6. The system of claim 5, wherein the controlling device includes a motorized pulley with a stationary pulley shell and a rotating pulley axle, and wherein the controlling of the pivoting movement, is by controlling rotation of the pulley axle.

7. The system of claim 2, wherein the holding device includes a supporting surface movable along a vertical axis between a first position where the supporting surface is adjacent the bottom surface of the bundle, and a second position where the supporting, surface is adjacent a conveying mechanism.

8. The system of claim 7, wherein the holding device includes a plurality of supporting columns, respective upper surfaces of which form together the supporting surface, wherein in the second position, the supporting columns are meshed with portions of the conveying mechanism such that the supporting surface is level with an upper surface of the conveying mechanism to transfer the bundle to the upper surface of the conveying mechanism.

9. The system of claim 2, wherein the holding device includes a receptacle positioned underneath the first and second supporting plates to catch the falling bundle.

10. The system of claim 2, wherein the holding device includes a receptacle configured to pivot between a first position and a second position, wherein in the first position the receptacle faces the bottom surfaces of the first and second supporting plates to catch the falling bundle, and in the second position the receptacle faces a conveying device, wherein the holding device is further configured to deposit the items onto the conveying device for further processing.

11. The system of claim 2, further comprising a plurality of gripping devices, positioned along respective facing side surfaces of the first and second supporting plates, wherein at least one of the gripping devices of the plurality of gripping devices disposed along the side surface of the first supporting plate and at least one of the gripping devices disposed along the side surface of the second supporting plate include a second cutting device configured to cut second straps on the bottom surface of the bundle while the first and second supporting plates are moving away from each other.

12. The system of claim 11, wherein the first straps are positioned in a direction perpendicular to the second straps.

13. The system of claim 11, wherein the first cutting device is configured to hold the cut first straps and the second cutting device is configured to hold the cut second straps.

14. The system of claim 2, wherein the gripping device releases the wrapping into one of a recycling bin and a trash chute.

15. The system of claim 2 interfacing with a package sorting system.

16. A package sorting system receiving a plurality of bundled packages to be sorted and shipped to different addresses, the package sorting system including a debundling system as claimed in claim 2.

* * * * *